US010774596B2

(12) United States Patent
Zhang et al.

(10) Patent No.: US 10,774,596 B2
(45) Date of Patent: Sep. 15, 2020

(54) ROLLING CUTTER STABILITY

(71) Applicant: SMITH INTERNATIONAL, INC., Houston, TX (US)

(72) Inventors: Youhe Zhang, Spring, TX (US); Chen Chen, New Haven, CT (US); Yuri Burhan, Spring, TX (US); Balasubramanian Durairajan, Sugar Land, TX (US); Sandeep Tammineni, Dhahran (SA)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/764,002

(22) PCT Filed: Sep. 21, 2016

(86) PCT No.: PCT/US2016/052727
§ 371 (c)(1),
(2) Date: Mar. 28, 2018

(87) PCT Pub. No.: WO2017/058581
PCT Pub. Date: Apr. 6, 2017

(65) Prior Publication Data

US 2018/0283106 A1 Oct. 4, 2018

Related U.S. Application Data

(60) Provisional application No. 62/234,555, filed on Sep. 29, 2015.

(51) Int. Cl.

| | |
|---|---|
| ***E21B 10/56*** | (2006.01) |
| ***E21B 10/62*** | (2006.01) |
| ***E21B 10/42*** | (2006.01) |

(52) U.S. Cl.
CPC ..... *E21B 10/56* (2013.01); *E21B 10/42* (2013.01); *E21B 10/62* (2013.01)

(58) Field of Classification Search
CPC ..... E21B 10/573; E21B 10/62; E21B 10/50
See application file for complete search history.

(56) References Cited

U.S. PATENT DOCUMENTS

| | | | |
|---|---|---|---|
| 3,499,685 | A | 3/1970 | Kniff et al. |
| 3,512,838 | A | 5/1970 | Kniff et al. |

(Continued)

FOREIGN PATENT DOCUMENTS

| | | | |
|---|---|---|---|
| CN | 2216137 | Y | 12/1995 |
| CN | 1155315 | A | 7/1997 |

(Continued)

OTHER PUBLICATIONS

International Search Report and Written Opinion issued in International Patent Application No. PCT/US2016/052727 dated Jan. 6, 2017, 16 pages.

(Continued)

*Primary Examiner* — Kristyn A Hall

(57) ABSTRACT

A cutting element includes a cutting end extending a depth from a cutting face to an interface surface opposite from the cutting face, and a spindle, the spindle axially separated from the cutting end by a transition region. The spindle has a spindle diameter measured between a spindle side surface, which is less than a cutting end diameter. A guide length, measured from a point of transition to the transition region to a retention feature, is longer than 75% of a total length of the spindle.

20 Claims, 33 Drawing Sheets

(56) References Cited

U.S. PATENT DOCUMENTS

| | | | |
|---|---|---|---|
| 3,690,728 | A | 9/1972 | Krekeler et al. |
| 4,084,856 | A | 4/1978 | Emmerich et al. |
| 4,104,344 | A | 8/1978 | Pope et al. |
| 4,247,147 | A | 1/1981 | Rettkowski |
| 4,288,248 | A | 9/1981 | Bovenkerk et al. |
| 4,553,615 | A | 11/1985 | Grainger |
| 4,582,364 | A | 4/1986 | Demey, III |
| 4,684,176 | A | 8/1987 | Den Besten et al. |
| 5,018,793 | A | 5/1991 | Den Besten |
| 5,127,923 | A | 7/1992 | Bunting et al. |
| 5,415,462 | A | 5/1995 | Massa |
| 5,655,614 | A | 8/1997 | Azar |
| 5,678,645 | A | 10/1997 | Tibbitts et al. |
| 5,730,502 | A | 3/1998 | Montgomery, Jr. |
| 5,906,245 | A | 5/1999 | Tibbitts et al. |
| 6,113,195 | A | 9/2000 | Mercier et al. |
| 6,786,557 | B2 | 9/2004 | Montgomery, Jr. |
| 7,338,135 | B1 | 3/2008 | Hall et al. |
| 7,703,559 | B2 | 4/2010 | Shen et al. |
| 7,717,523 | B2 | 5/2010 | Weaver |
| 7,762,359 | B1 | 7/2010 | Miess |
| 7,837,277 | B2 | 11/2010 | Weaver |
| 8,091,655 | B2 | 1/2012 | Shen et al. |
| 8,267,483 | B2 | 9/2012 | Kramer et al. |
| 8,413,746 | B2 | 4/2013 | Shen et al. |
| 8,727,043 | B2 | 5/2014 | Zhang et al. |
| 8,881,849 | B2 | 11/2014 | Shen et al. |
| 8,991,523 | B2 | 3/2015 | Shen et al. |
| 9,187,962 | B2 | 11/2015 | Burhan et al. |
| 9,322,219 | B2 | 4/2016 | Burhan et al. |
| 9,328,564 | B2 | 5/2016 | Zhang et al. |
| 9,464,486 | B2 | 10/2016 | Zhang et al. |
| 9,605,486 | B2 | 3/2017 | Burhan et al. |
| 9,624,731 | B2 | 4/2017 | Haugvaldstad et al. |
| 9,976,356 | B2 | 5/2018 | Burhan et al. |
| 2004/0118615 | A1 | 6/2004 | Beach |
| 2006/0006727 | A1 | 1/2006 | Frear |
| 2006/0033379 | A1 | 2/2006 | Frear |
| 2006/0260846 | A1 | 11/2006 | Portwood et al. |
| 2006/0261663 | A1 | 11/2006 | Sollami |
| 2007/0144789 | A1 | 6/2007 | Johnson et al. |
| 2007/0205023 | A1 | 9/2007 | Hoffmaster et al. |
| 2007/0278017 | A1 | 12/2007 | Shen et al. |
| 2008/0115978 | A1 | 5/2008 | Hall et al. |
| 2008/0202819 | A1 | 8/2008 | Fader |
| 2009/0205870 | A1 | 8/2009 | Smith |
| 2009/0284069 | A1 | 11/2009 | Watson et al. |
| 2010/0108403 | A1 | 5/2010 | Keshavan |
| 2010/0218999 | A1 | 9/2010 | Jones et al. |
| 2010/0219001 | A1 | 9/2010 | Shen et al. |
| 2010/0314176 | A1 | 12/2010 | Zhang et al. |
| 2011/0241407 | A1 | 10/2011 | Fader et al. |
| 2011/0284293 | A1 | 11/2011 | Shen et al. |
| 2012/0073881 | A1 | 3/2012 | Shen et al. |
| 2012/0273280 | A1 | 11/2012 | Zhang et al. |
| 2012/0273281 | A1 | 11/2012 | Burhan et al. |
| 2013/0169022 | A1 | 7/2013 | Monyak et al. |
| 2013/0199857 | A1 | 8/2013 | Schwefe et al. |
| 2013/0220707 | A1 | 8/2013 | Shen et al. |
| 2013/0333953 | A1 | 12/2013 | Zhang et al. |
| 2014/0054094 | A1 | 2/2014 | Burhan et al. |
| 2014/0339882 | A1 | 11/2014 | Hall et al. |
| 2014/0360792 | A1 | 12/2014 | Azar et al. |
| 2017/0191317 | A1 | 7/2017 | Burhan et al. |

FOREIGN PATENT DOCUMENTS

| | | | |
|---|---|---|---|
| CN | 1651711 | A | 8/2005 |
| CN | 101255795 | A | 9/2008 |
| WO | WO9605404 | A1 | 2/1996 |
| WO | WO2007024171 | A1 | 3/2007 |
| WO | WO2013074898 | A1 | 5/2013 |
| WO | WO2013101860 | A1 | 7/2013 |
| WO | WO2017087920 | A1 | 5/2017 |

OTHER PUBLICATIONS

International Search Report and Written Opinion issued in International Patent Application No. PCT/US2013/051317 dated Oct. 8, 2013, 14 pages.

International Preliminary Report on Patentability issued in International Patent Application No. PCT/US2013/051317 dated Feb. 24, 2015, 12 pages.

First Office Action and Search report issued in Chinese Patent Application No. 201380049452.2 dated Nov. 30, 2015, 25 pages.

Second Office Action report issued in Chinese Patent Application No. 201380049452.2 dated May 23, 2016, 6 pages.

Third Office Action issued in Chinese Patent Application No. 201380049452.2 dated Nov. 30, 2016, 6 pages.

Office Action issued in U.S. Appl. No. 13/972,465 dated Nov. 6, 2015, 14 pages.

Office Action issued in U.S. Appl. No. 13/972,465 dated Apr. 18, 2016, 18 pages.

Office Action issued in U.S. Appl. No. 13/972,465 dated Aug. 25, 2016, 8 pages.

Office Action issued in U.S. Appl. No. 15/466,446 dated May 19, 2017, 9 pages.

Office Action issued in U.S. Appl. No. 15/466,446 dated Oct. 20, 2017, 7 pages.

Examination Report under 94(3) EPC issued in European Patent Application No. 13757695.5 dated Nov. 24, 2015, 5 pages.

Search Report R 61 issued in European Patent Application No. 13757695.5 dated Nov. 2, 2015, 3 pages.

International Search Report and Written Opinion issued in International Patent Application No. PCT/US2013/029771 dated Jun. 4, 2013, 12 pages.

International Preliminary Report on Patentability issued in International Patent Application No. PCT/US2013/029771 dated Sep. 18, 2014, 9 pages.

Office Action issued in U.S. Appl. No. 13/786,085 dated May 4, 2015, 7 pages.

Office Action issued in U.S. Appl. No. 13/786,085 dated Sep. 21, 2015, 6 pages.

First Office Action and Search Report issued in Chinese Patent Application No. 201380021302.0 dated Aug. 24, 2015, 25 pages.

Second Office Action and Search Report issued in Chinese Patent Application No. 201380021302.0 dated May 12, 2016, 25 pages.

Office Action issued in U.S. Appl. No. 15/981,225 dated Aug. 10, 2018, 25 pages.

International Preliminary Report on Patentability issued in International Patent Application No. PCT/US2016/052727 dated Apr. 12, 2018, 13 pages.

First Office Action and Search Report issued in Chinese patent application 201680056817.8 dated Feb. 22, 2019, 19 pages.

ROLLING CUTTER STABILITY

CROSS-REFERENCE TO RELATED APPLICATIONS

This application is the United States national phase of International Patent Application Serial No. PCT/US2016/052727, filed Sep. 21, 2016 and titled "Improvements on Rolling Cutter Stability," which claims the benefit of, and priority to, U.S. Patent Application Ser. No. 62/234,555, filed Sep. 29, 2015 and titled "Improvements on Rolling Cutter Stability," which application is expressly incorporated herein by this reference in its entirety.

BACKGROUND

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter" drill bits, include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material that forms the bit body are commonly referred to as "impreg" bits. Drag bits having cutting elements made of an ultra hard cutting surface layer or "table" (which may be made of polycrystalline diamond material or polycrystalline boron nitride material) deposited onto or otherwise bonded to a substrate are known in the art as polycrystalline diamond compact ("PDC") bits.

In PDC bits, PDC cutters are received within cutter pockets, which are formed within blades extending from a bit body, and may be bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

A PDC cutter may be formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate may be made of a metal-carbide composite material, such as tungsten carbide-cobalt. The deposited diamond layer is often referred to as the "diamond table" or "abrasive layer."

An example of PDC bit having a plurality of cutters with ultra hard working surfaces is shown in FIGS. 1 and 2. The drill bit 100 includes a bit body 110 having a threaded upper pin end 111 and a cutting end 115. The cutting end 115 includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at angular orientations and radial locations relative to a working surface and with a back rake angle and side rake angle against a formation to be drilled.

A plurality of orifices 116 are positioned on the bit body 110 in the areas between the blades 120, which may be referred to as "gaps" or "fluid courses." The orifices 116 are adapted to accept nozzles. The orifices 116 allow drilling fluid to be discharged through the bit 100 in selected directions and at selected rates of flow between the blades 120 for lubricating and cooling the drill bit 100, the blades 120, and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel upward past the drill bit 100 toward the surface of a wellbore.

Referring to FIG. 2, a top view of a prior art PDC bit is shown. The cutting face 118 of the bit shown includes a plurality of blades 120, and each blade has a leading side 122 facing the direction of bit rotation, a trailing side 124 (opposite from the leading side 122), and a top side 126 that faces the formation. Each blade 120 includes a plurality of cutting elements or cutters extending radially from the center of cutting face 118 and generally forming rows. Certain cutters, although at differing axial positions, may occupy radial positions that are in similar radial position to other cutters on other blades.

Cutters may be attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to a few alloys that offer relatively low brazing temperatures to avoid or reduce damage to the diamond layer and high enough braze strength to retain cutting elements on drill bits.

A factor in determining the longevity of PDC cutters is the exposure of the cutter to heat. Polycrystalline diamond may be stable at temperatures of up to 700-750° C. in air, above which observed increases in temperature may result in damage to and structural failure of polycrystalline diamond. This deterioration in polycrystalline diamond may be due to the substantial difference in the coefficient of thermal expansion of the binder material (e.g., cobalt), as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

SUMMARY

In some aspects, a cutting element includes a cutting end extending a depth from a cutting face to an interface surface opposite the cutting face and a spindle. The spindle is axially separated from the cutting end by a transition region, and the spindle has a spindle diameter at a spindle side surface that is less than a cutting end diameter and a guide length measured from a point of transition to the transition region to a retention feature. The guide length is longer than 75% of a total length of the spindle.

In some aspects, a cutting element assembly includes a cutting element having a cutting end, a spindle, and a retention feature disposed along a spindle side surface. The assembly also includes a sleeve having an inner diameter at an inner surface of the sleeve, an outer diameter at an outer surface of the sleeve, and a taper extending axially from a base of the sleeve a length along the sleeve. The taper is formed by a decreasing outer diameter, and the spindle is within the sleeve such that the taper axially overlaps the retention feature.

In some further aspects, a cutting element assembly includes a cutting element having a cutting end extending a depth from a cutting face to an interface surface opposite from the cutting face, a spindle. A spindle diameter at a spindle side surface is less than a cutting end diameter at a cutting end side surface. A transition region having a transition surface extends from a point of transition from the interface surface to a point of transition from the spindle side surface. A cross-sectional profile of the transition surface has at least one planar surface. A taper line measured from the point of transition from the interface surface to the point of transition from the spindle side surface forms a taper angle with a line tangent to the spindle side surface, and the taper angle ranges from 5° to 85°. The cutting element assembly may also include an outer support, where the spindle is within the outer support, and a retention feature between the spindle and the outer support.

In still additional aspects, a cutting element assembly includes a sleeve, a cutting element partially within the sleeve, the cutting element having a cutting end, a spindle, the spindle axially separated from the cutting end by a transition region, and a retention feature along a spindle side surface. The assembly also includes at least one seal between the sleeve and the cutting element, the at least one seal having a quadrilateral cross-sectional shape.

This summary is provided to introduce a selection of concepts that are further described below in the detailed description. This summary is not intended to identify key or essential features of the claimed subject matter, nor is it intended to be used as an aid in limiting the scope of the claimed subject matter. Other aspects and features of the description and claimed subject matter will be apparent from the following description and the appended claims.

BRIEF DESCRIPTION OF DRAWINGS

FIGS. 40-1 to 40-6 show FEA simulation results of stress concentrations for various cutting elements having a 13 mm cutting end diameter.

FIGS. 42-1 to 42-4 show FEA simulation results of stress concentrations for various cutting elements having a 16 mm cutting end diameter.

DETAILED DESCRIPTION

Embodiments of the present disclosure relate to cutting elements that are free to rotate about their longitudinal axes. In some aspects, embodiments of the present disclosure relate to cutting elements retained within a sleeve or cutter pocket such that the cutting elements are mechanically retained (and not rotatable) within the sleeve structure or cutter pocket. The cutting elements may be used in a drill bit or other cutting tool.

According to embodiments of the present disclosure, a cutting element may be partially within a sleeve or outer support member, where the assembled combination of the cutting element and sleeve may be referred to as a cutting element assembly. During operation of a cutting element assembly, drilling forces may displace or move the cutting element out of alignment within the sleeve, which may lead to failure of the cutting element assembly. By limiting the displacement of the cutting element within the sleeve of a cutting element assembly, the life of the cutting element assembly may be improved. In some embodiments, the length of the sleeve and a portion of the cutting element therein may be extended in order to limit displacement. In some embodiments, the tolerance or spacing between the interfacing sleeve and cutting element surfaces may be reduced in order to reduce the displacement of the cutting element within the sleeve. Further, in some embodiments, a cutting element assembly may include one or more seals between the interfacing sleeve and cutting element surfaces, which may provide damping towards impact forces and reduce lateral movement of the cutting element. One or more seals may also be used in a cutting element assembly to inhibit contaminant from entering the cutting element assembly and/or inhibit grease or lubricant, if used, from leaving the cutting element assembly.

Figure 3:
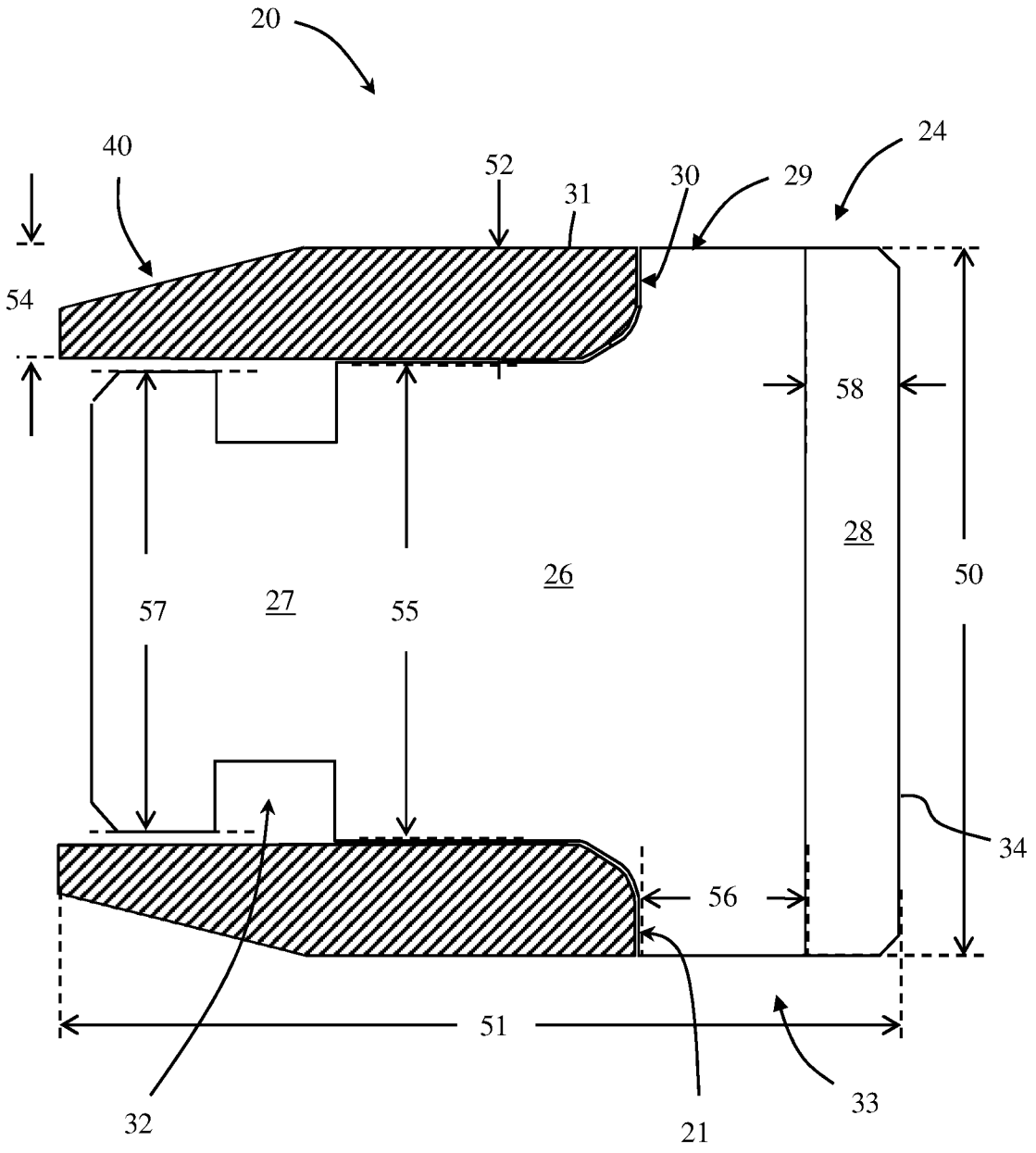
FIG. 3 is a partial cross-sectional view of a cutting assembly according to some embodiments of the present disclosure.

FIG. 3 shows an example of a cutting element assembly 20 having a cutting element 24 partially within and retained to a sleeve 22. Cutting element 24 may, in some embodiments, be formed of two components, a carbide substrate 26 and an ultrahard material layer 28, such as a diamond table, on an upper surface of the carbide substrate 26. A lower portion 27 of the carbide substrate 26 forms a spindle within the sleeve 22. The substrate 26 may have an upper portion 29 extending axially above the spindle 27 from a radial bearing surface 30 to interface with the ultrahard material layer 28. Further, a transition region 31 is formed between the radial bearing surface 30 and the spindle 27. The cutting element 24 may be retained within the sleeve by a variety of retention mechanisms such as by retention balls, springs, pins, etc. Various examples of such types of retention mechanisms (as well as other variations on the cutting assemblies suitable for use in the present disclosure) include those disclosed in U.S. Patent Publication Nos. 2010/0314176 and 2012/0273281; and U.S. Pat. No. 7,703,559, the entire disclosures of which are incorporated herein by reference.

In some embodiments, the retention mechanism may limit the axial movement or displacement of the cutting element 24 with respect to sleeve 22. In such embodiments, the cutting elements may be rotatable within the sleeve, i.e., about the longitudinal axis of the cutting element 20. In other embodiments, the retention mechanism may limit the axial movement or displacement as well as rotational movement of the cutting element 24 with respect to sleeve 22.

The sleeve 22 and cutting element 24 may have substantially the same outer diameter as each other, or in some embodiments, the sleeve 22 may have a greater outer diameter than the cutting element. As shown, the cutting element 24 may have an outer diameter 50, and the radial bearing surface 30 may include a substantially planar surface extending to the outer diameter of the sleeve having a radial length 52. The thickness 54 of the sleeve 22 may be selected based on the radial length 52 of the substantially planar surface of radial bearing surface 30 and the outer diameter 50 of the cutting element 24. Further, as shown, the thickness 54 of the sleeve may vary along its length, for example, to form a taper 40. The taper 40 is formed by a gradually increasing sleeve thickness 54 that extends from the sleeve base an axial length, where the axial length is greater than the sleeve thickness 54 measured at its greatest thickness. Tapers according to other embodiments are described more below.

The cutting element 24 has a cutting end 33 (including the upper portion 29 of the substrate and the ultrahard material layer 28 shown in FIG. 3) that extends axially above the spindle 27 and sleeve 22 from the radial bearing surface 30 to a cutting face 34 of the cutting element 24. The height of the axial extension of the carbide substrate 26 from the radial bearing surface 30 to the ultrahard material layer 28 may be referred to as axial extension 56. Further, in the illustrated embodiment, ultrahard material layer 28 may have a thickness 58, where the cutting end 33 has a depth equal to the sum of the thickness of the axial extension and the thickness of the ultrahard material layer.

The spindle 27 has a retention feature 32 formed along the spindle side surface. As shown in FIG. 3, the retention feature 32 may be a circumferential groove. In other embodiments, the retention feature may be, for example, one or more cavities, one or more protrusions, or one or more ridges. A diameter 55 of the spindle portion axially above the retention feature and a diameter 57 of the spindle portion axially below the retention feature may be equal or unequal. For example, in some embodiments, the diameter 57 of the spindle portion axially below the retention feature may be less than the diameter 55 of the spindle portion axially above the retention feature. The portion of the spindle 27 above the retention feature 32 and extending to the transition region 31 is referred to as the guide length of the cutting element. Further, the cutting element assembly 20 may have a total length 51. According to embodiments of the present disclosure, a cutting element assembly may have a ratio of a total length of the cutting element assembly to a diameter of the cutting element assembly that is greater than 1:1, greater than 5:4, or greater than 3:2. In some embodiments, the ratio of a total length to a diameter of the cutting element assembly may be less than 5:1, less than 5:2, or less than 5:3. In some embodiments, the ratio may be greater than the ratios described above (e.g., greater than 1:1) and less than the other ratios described above (e.g., less than 5:1) (e.g., greater than 1:1 and less than 5:1).

According to embodiments of the present disclosure, a cutting element may include a cutting face, a radial bearing surface opposite from the cutting face, a cutting end extending a depth from the cutting face to the radial bearing surface, and a spindle, the spindle axially separated from the cutting end by a transition region, where the diameter of the spindle is less than the diameter of the cutting end. The spindle may include a guide length measured from a point of transition to the transition region to a retention feature. The guide length of a cutting element according to embodiments of the present disclosure may be longer than ½ (50%), ⅗ (60%), ⅔ (66.7%), ¾ (75%), or ⅘ (80%) of a total length of the spindle. The guide length of a cutting element may be shorter than 9/10 (90%), ⅞ (87.5%), or ⅚ (83.3%) of a total length of the spindle. In some embodiments, the ratio may be greater than the ratios described above (e.g., greater than ½ or 50%) and less than the other ratios described above (e.g., less than 9/10 or 90%). For instance, the ratio may be greater than ½ (50%) and less than 9/10 (90%).

According to embodiments of the present disclosure, a transition surface may be designed based on one or more dimensions of the cutting element. For example, referring still to FIG. 3, the transition surface 31 may be designed based on at least one of the diameter 55 of the spindle portion axially above the retention feature 32, the total length 51 of the cutting element assembly, the total length of the cutting element, the radial length 52 of the radial bearing surface 30, the outer diameter 50 of the cutting element 24, or a combination of cutting element 24 dimensions, such as, for example, the radial length 52 of the radial bearing surface 30 and the total length of the cutting element 24. In some embodiments, the transition surface 31 may also be designed based on the material properties of the cutting element 24. Further, as described more below, the transition surface design may include, for example, selecting size, such as radial and axial lengths of extension, shape, such as planar and/or non-planar surfaces, angle of orientation from the spindle to the radial bearing surface, and, if a seal is included, seal placement.

Figure 4:
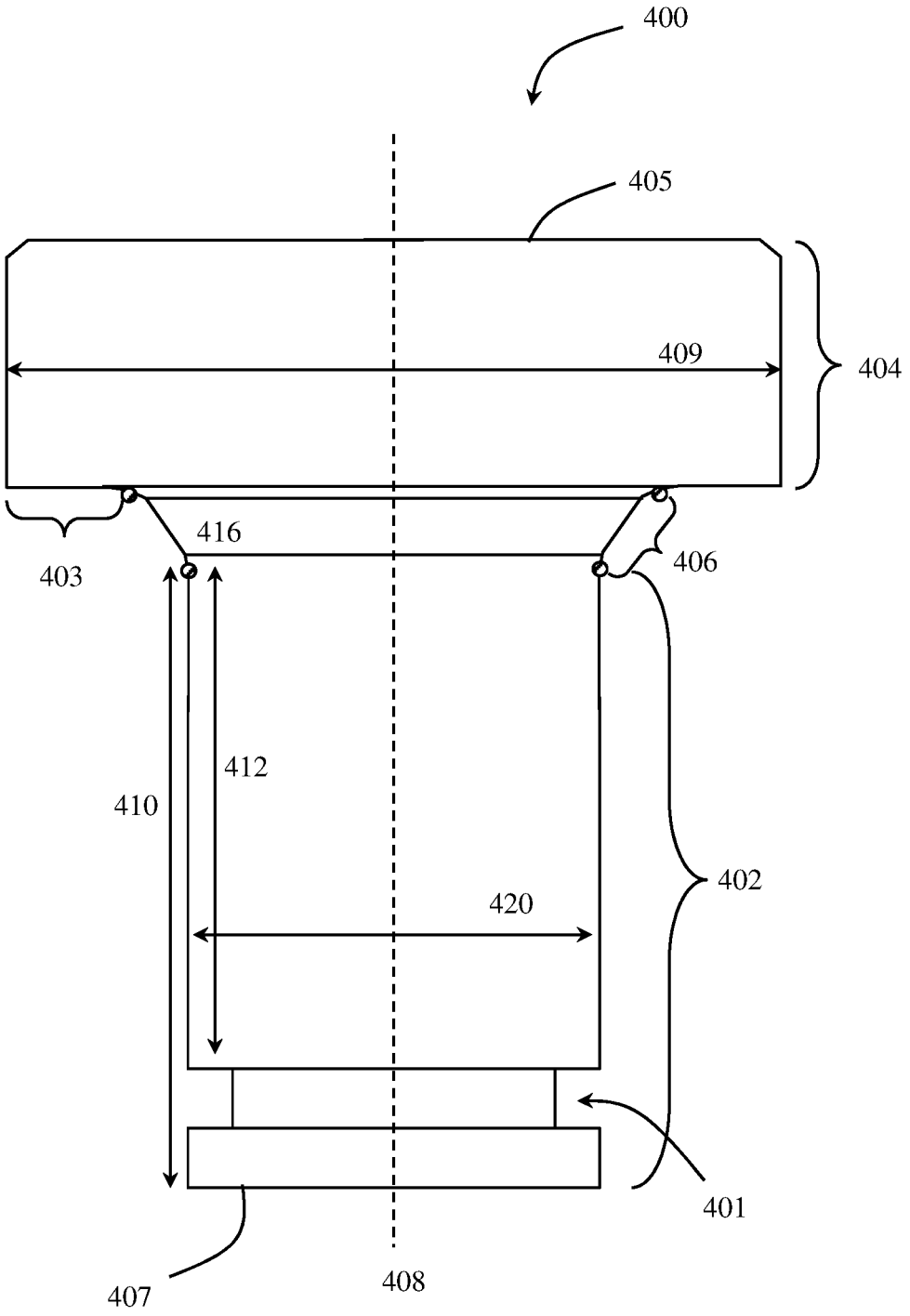
FIG. 4 is a partial cross-sectional view of a cutting element according to some embodiments of the present disclosure.

FIG. 4 shows an example of a cutting element according to embodiments of the present disclosure, where the cutting element 400 has a spindle 402 axially separated from a cutting end 404 by a transition region 406, a retention feature 401 disposed along the length of the spindle side surface, and a longitudinal axis 408 extending therethrough. The cutting end 404 extends a depth from a cutting face 405 to a radial bearing surface 403 and has a diameter 409. In some embodiments, the cutting end may include a diamond table that forms the cutting face and a substrate that extends from the diamond table to the base of the spindle, thereby forming part of the cutting end, the transition region and the spindle. In other embodiments, a cutting element may be formed of more than two types of materials. For example, a cutting element may include an ultrahard material table forming the cutting face, a carbide or other cermet material forming a substrate, and one or more transition materials between the ultrahard material table and substrate, where a transition material may include a mixture of ultrahard and cermet materials or one or more cermets different from the substrate material. In yet other embodiments, the entire cutting element may be formed from a single material.

The spindle 402 has a total length 410 and a guide length 412, where the total length is measured from the base 407 of the spindle to a point of transition 416 to the transition region 406, and the guide length 412 is measured from the retention feature 401 to the point of transition 416 to the transition region. Thus, the lengths of the total length 410 of the spindle and the guide length 412 of the spindle are measured from the same axial point along the cutting element, 416, and extend different axial distances along the spindle. As shown, the retention feature 401 is a circumferential groove formed around the spindle side surface. In such embodiments, the guide length 412 is measured from the wall of the circumferential groove axially closest to the cutting end 404. In other embodiments, the guide length may be measured from the point of the retention feature axially closest the cutting end to the point of transition to the transition region. The point of transition 416 to the transition region from the spindle may be defined as the point at which the slope of the line tangent to the spindle side surface changes. In other words, a line tangent to the spindle side surface may have a substantially constant slope (excluding any surface alterations which may act as a retention feature), which extends to the point of transition 416 to the transition region surface.

According to embodiments of the present disclosure, the guide length may range from greater than 60% of the total length of the spindle, from 70% to 95% of the total length of the spindle, or from 75% to 90% of the total length of the spindle. For example, as shown in FIG. 4, the guide length 412 may be greater than 75% of the total length of the spindle. The guide length of a spindle may also be measured with respect to the total length of the cutting element, i.e., from the base 407 of the spindle to the cutting face 405. According to some embodiments of the present disclosure, a guide length may range from greater than 50% of the total length of the cutting element, from 55% to 85% of the total length of the cutting element, or from 60% to 75% of the total length of the cutting element. For example, as shown in FIG. 4, the guide length 412 is greater than 60% of the total length of the cutting element 400. Further, in some embodiments, the guide length 412 may be measured with respect to the cutting end diameter, where the cutting end diameter is the diameter of the cutting element at its cutting end, such as shown as 409 in FIG. 4. For example, according to embodiments of the present disclosure, a guide length 412 may range from greater than 60% of the cutting end diameter, from greater than 75% of the cutting end diameter, greater than 90% of the cutting end diameter, and in some embodiments, the guide length 412 may be equal to or larger than the cutting end diameter (e.g., 110% or 120% of the cutting end diameter). In some embodiments, the guide length 412 may be measured with respect to the diameter of the cutting element spindle, such as shown as 420 in FIG. 4, where the diameter may be an outer diameter measured along the guide length portion of the spindle or at the base of the spindle. For example, according to some embodiments of the present disclosure, a ratio of the guide length to the diameter of the cutting element spindle may include limits of 3:4, 1:1, 3:2, 2:1, or 3:1, where any limit may be used in combination with any other limit (e.g., a ratio between 3:4 and 2:1).

Figure 5:
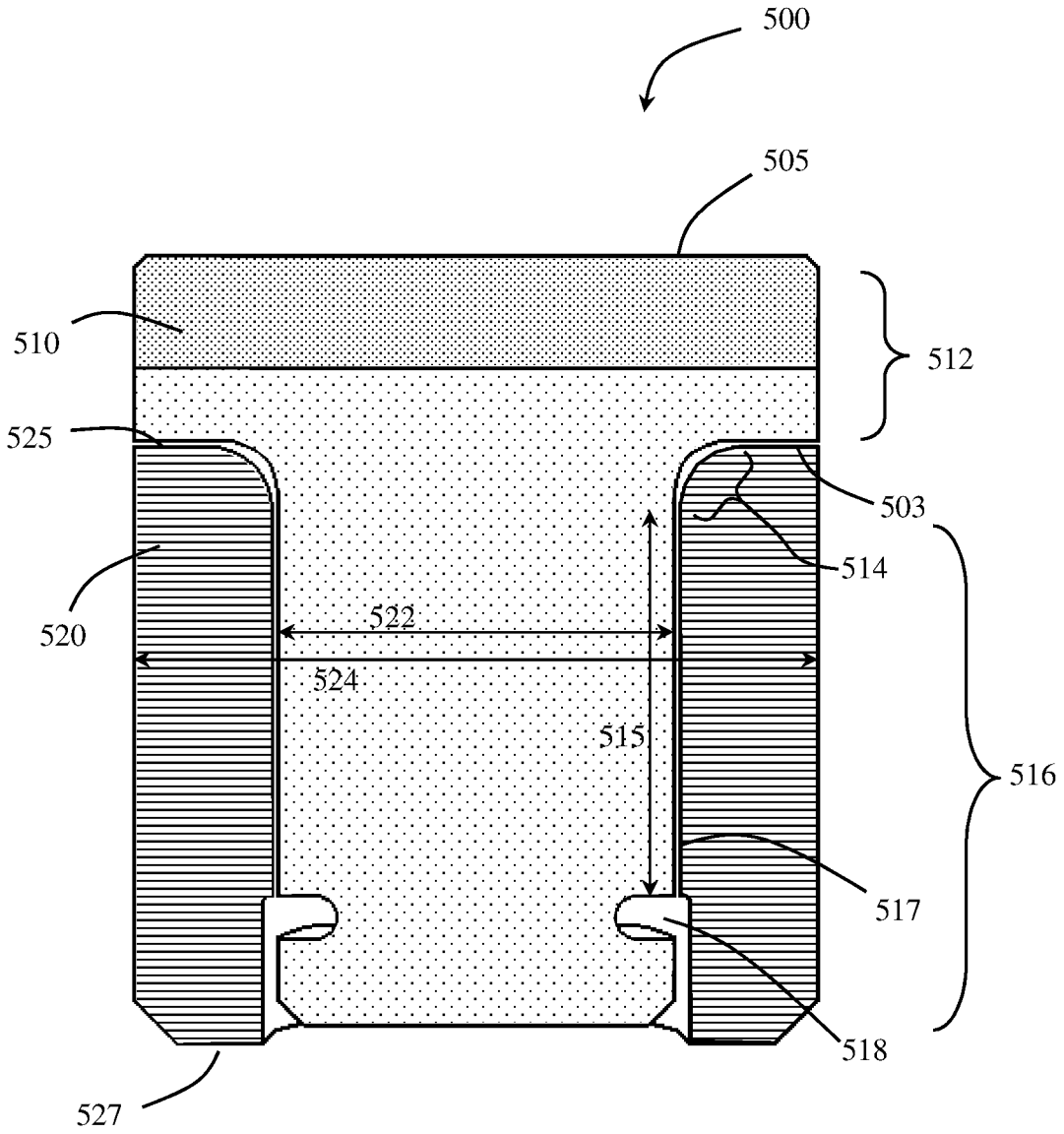
FIGS. 5 and 6 are cross-sectional views of cutting element assemblies according to some embodiments of the present disclosure.

Referring now to FIG. 5, a cross-sectional view of a cutting element assembly according to embodiments of the present disclosure is shown. The cutting element assembly 500 has a cutting element 510 according to embodiments of the present disclosure partially in a sleeve 520. The cutting element may include a cutting end 512, a transition region 514 and a spindle 516. The cutting end 512 is defined as the portion of the cutting element between the cutting face 505 and the radial bearing surface 503. The spindle 516 portion of the cutting element includes a retention feature 518 formed at a guide length 515 from the transition region 514 along a spindle side surface 517. The retention feature 518 shown is a circumferential groove formed around the circumference of the spindle; however, other embodiments may have other retention features, such as a protrusion or ridge, and some embodiments may have more than one retention feature formed on the spindle side surface.

The sleeve 520 has an inner diameter 522 at the inner surface of the sleeve and an outer diameter 524 at the outer surface of the sleeve. As shown, the inner diameter 522 and outer diameter 524 of the sleeve may vary along its length, thereby forming a varying sleeve thickness. For example, the inner diameter 522 of the sleeve is relatively larger at the axial length corresponding with the retention feature 518 formed in the cutting element 510, such that a space is formed between the retention feature and the increase in the inner diameter 522. A retention mechanism may be within the space to retain the cutting element 510 in the sleeve 520. According to some embodiments, the varying inner diameter of a sleeve may include a circumferential groove formed in the inner surface of the sleeve at an axial position corresponding with a retention feature formed in the spindle of a cutting element. For example, in some embodiments, a cutting element may have a circumferential groove formed around the spindle of the cutting element, and a sleeve around the cutting element may have a corresponding circumferential groove formed around its inner surface, such that at least a portion of the corresponding circumferential groove of the sleeve shares an axial position with the circumferential groove of the cutting element. A retention mechanism may be between the corresponding circumferential grooves to retain the cutting element within the sleeve. In other embodiments, differently shaped retention features formed in a cutting element may share an axial position with at least a portion of differently shaped retention features formed in a sleeve of a cutting element assembly.

Further, the sleeve has a length 526 measured between a top surface 525 and a bottom surface 527, where the top surface 525 interfaces with the cutting element radial bearing surface 503. The length 526 of the sleeve extends at least the sum of the axial length of the cutting element transition region 514 and the axial length of the cutting element guide length 515. According to some embodiments, the length of the sleeve may be equal to the sum of the axial lengths of the transition region and spindle portions of a cutting element retained therein. In some embodiments, such as shown in FIG. 5, the length 526 of the sleeve may be greater than the sum of the axial lengths of the transition region 514 and spindle 516 portions.

Figure 6:
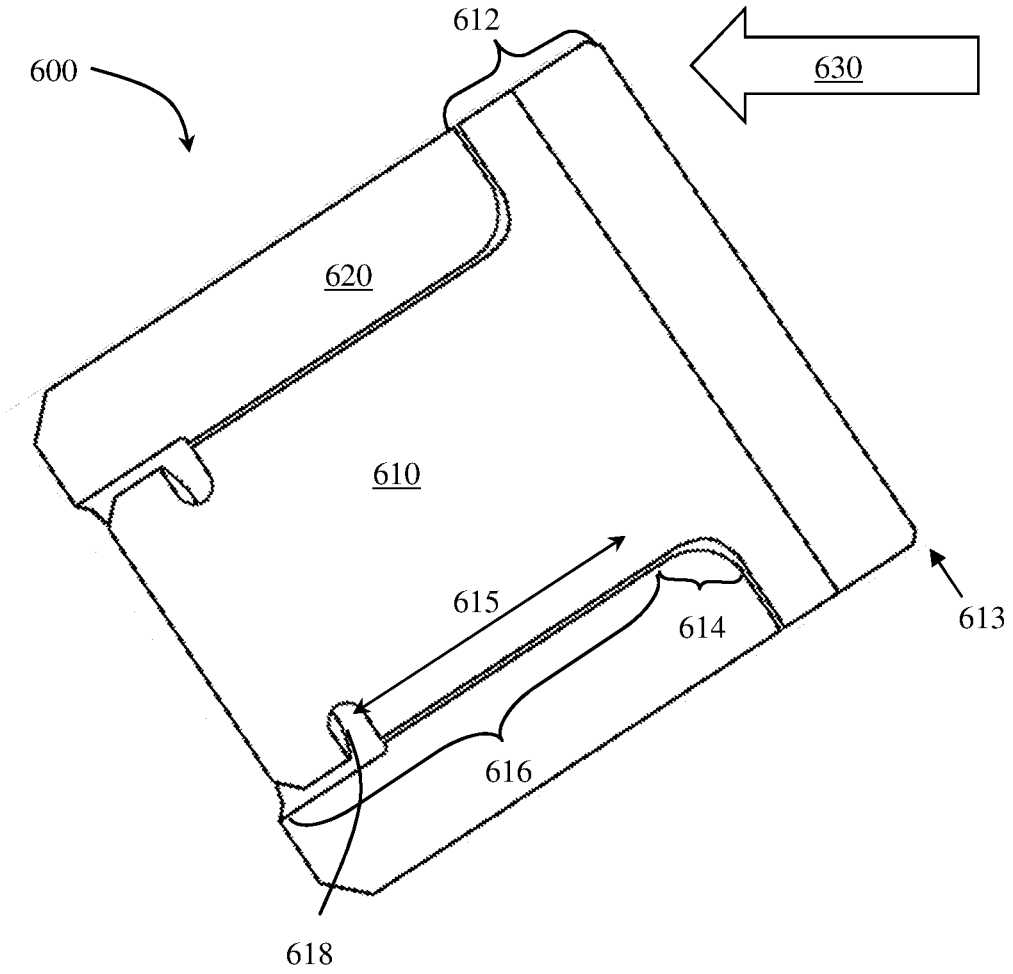

The guide length of a cutting element spindle and a corresponding length of a sleeve in which the cutting element is positioned may be extended to increase stability of the cutting element assembly. For example, during drilling, a rotatable cutting element assembly may consistently be subjected to fluctuating drilling and vertical load. Due to tolerance differences between the rotating cutting element and the sleeve, the cutting element may move under the load and generate kinetic energy. Once the amount of kinetic energy generated passes a certain critical value, the cutting element may be considered unstable and its fatigue life may drop. Thus, stability of a cutting element assembly according to embodiments of the present disclosure may be quantified using an equation for kinetic energy of the cutting element assembly during performance, where the kinetic energy, Ek, is equal to the product of the net force, F, the cutting element assembly is subjected to during performance and the displacement, s, of the cutting element within the sleeve. In some embodiments, extending the guide length of the cutting element limits cutting element displacement, thereby reducing the kinetic energy and improving cutting element assembly stability. Referring now to FIGS. 6-9, finite element analysis was performed to test cutting element assembly performance with different guide lengths. FIG. 6 shows the model of a cutting element assembly 600 having a cutting element 610 partially within a sleeve 620. The cutting element 610 has a cutting end 612, a transition region 614, and a spindle 616. The spindle 616 has a guide length 615 measured from the transition region 614 to a retention feature 618 formed along the spindle side surface. Parameters of the simulations included a cutting force 630 of 3,000 lbf (1360 kgf), a 20° back rake angle, and a 0.08 in. (2 mm) depth of cut. A displacement 613 was measured at the bottom tip, or cutting portion, of the cutting end 612 to compare movement of the cutting element within the sleeve 620.

Figure 7:
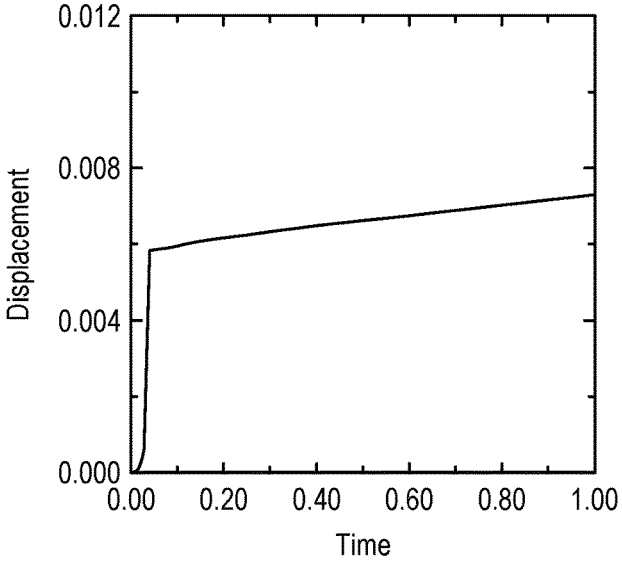
FIGS. 7 to 9 are graphs of simulation results for cutting performance of cutting element assemblies.
Figure 8:
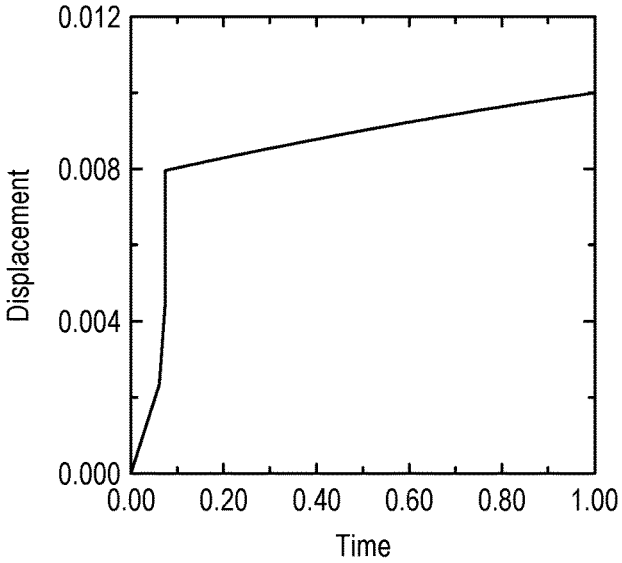
Figure 9:
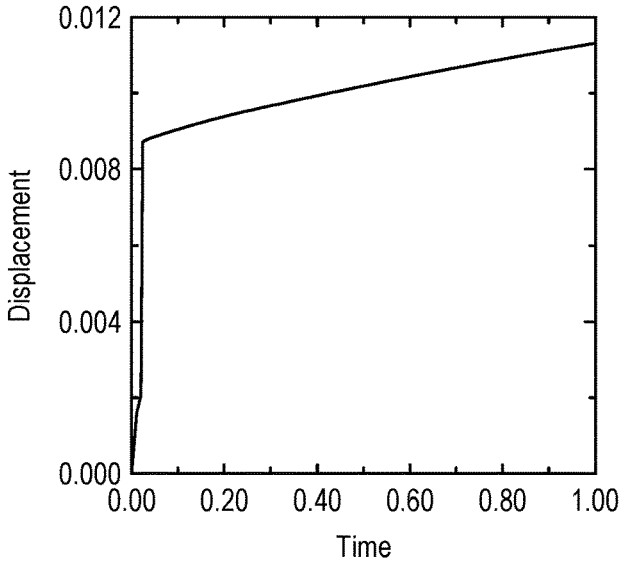

FIG. 7 shows the simulation results for the cutting element assembly having a guide length of 0.303 in. (7.70 mm), where the resulting displacement is 0.0073 in. (0.18 mm). FIG. 8 shows the simulation results for the cutting element assembly having a guide length of 0.267 in. (6.78 mm), where the resulting displacement is 0.0099 in. (0.25 mm). FIG. 9 shows the simulation results for the cutting element assembly having a guide length of 0.243 in. (6.17 mm), where the resulting displacement is 0.0113 in. (0.287 mm). Thus, as the guide length was increased, the simulated displacement decreased. Further, the simulated cutting element assemblies were manufactured and tested in the field, where the cutting element assembly having a displacement of 0.0073 in. (0.18 mm) survived and the cutting element assemblies having displacements of 0.0099 in. (0.25 mm) and 0.011 in. (0.29 mm) failed.

Figure 10:
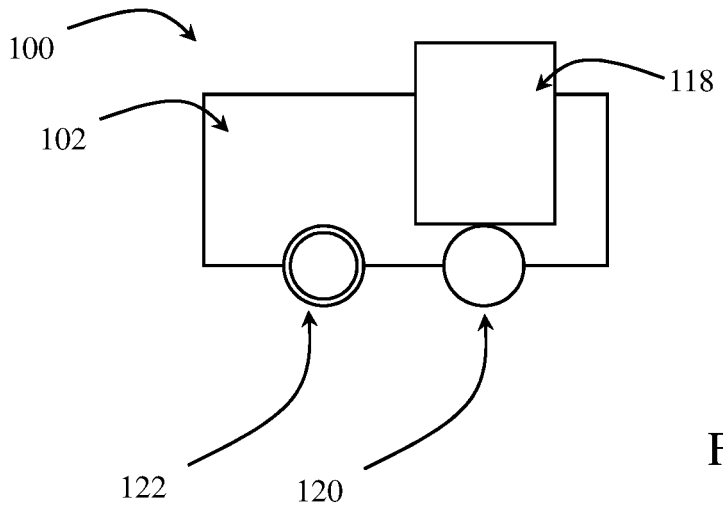
FIG. 10 is a schematic illustration of a fatigue testing apparatus.
Figure 11:
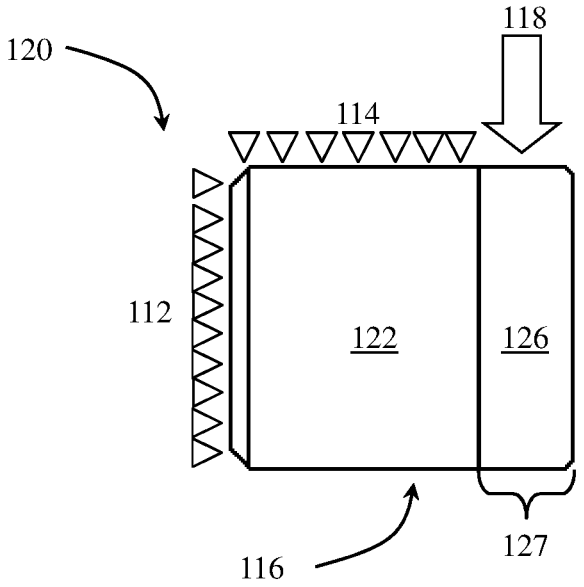
FIG. 11 is a force diagram for performing fatigue testing on a cutting element assembly.
Figure 12:
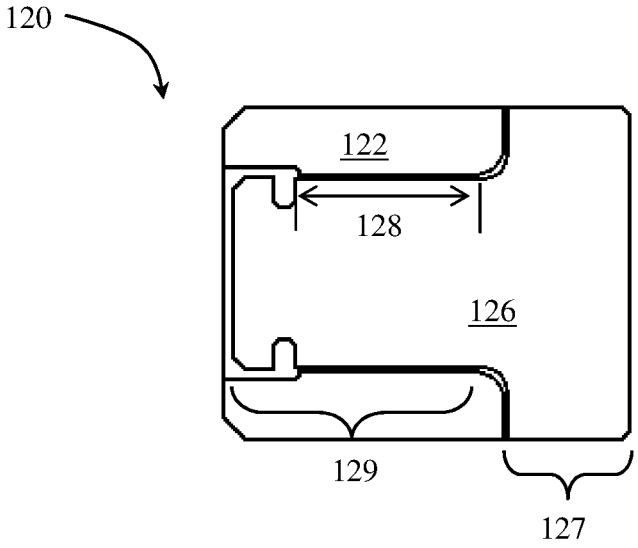
FIG. 12 is a cross-sectional view of a cutting element assembly prepared for fatigue testing.
Figure 13:
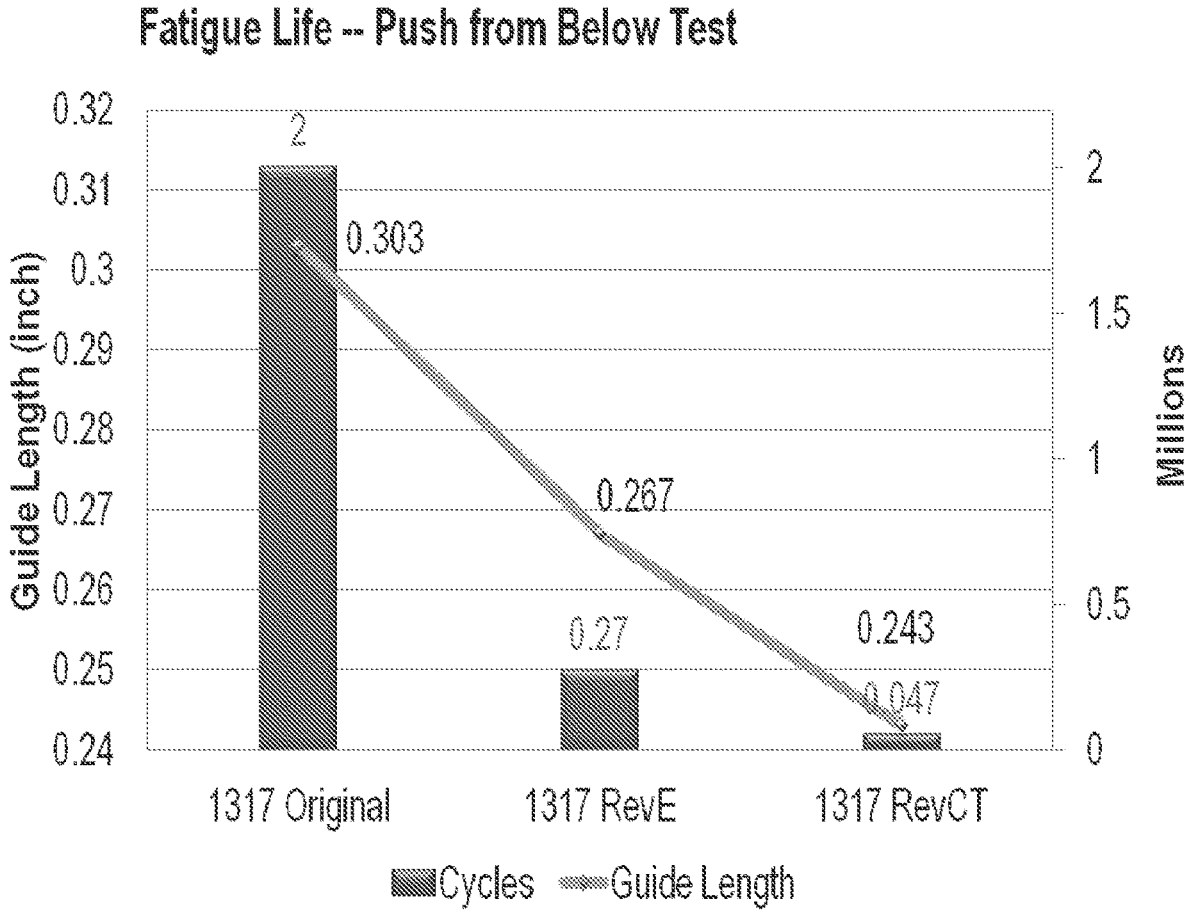
FIG. 13 is a graph of the results for fatigue testing on cutting element assemblies.

Referring now to FIGS. 10-13, fatigue and static testing was performed on cutting element assemblies to test cutting element stability. As shown in FIG. 12, the cutting element assemblies 120 were set up by brazing a sleeve 122 into a testing coupon 102. A cutting element 126 was then installed into the sleeve 122, where each cutting element 126 has a cutting end 127 and a guide length 128 measured along its spindle 129, from the cutting element transition region to a retention feature formed in the spindle. Cutting elements having guide lengths of 0.303 in. (7.70 mm), 0.267 in. (6.78 mm), and 0.243 in. (6.17 mm) were tested. As shown in FIG. 10, the cutting element assemblies 120 were loaded into a testing apparatus 100 and a radial load was applied to the cutting ends of each cutting element. FIG. 11 shows a force diagram of the cutting element assemblies 120 being tested. As shown, the cutting element assembly 120 was horizontally positioned in the testing apparatus 100 such that a back side 112 and a top side 114 of the sleeve 122 was fixed and a bottom side 116 of the cutting element assembly 120 was not supported. For static testing, a radial load 118 was applied to a top side of the cutting end 127 until the cutting element assembly failed. For fatigue testing, a radial load 118 ranging from 500-1500 lbf (225-680 kgf) was applied at a 20 HZ frequency for two million cycles. FIG. 13 shows a graph of the results for the fatigue testing, where cutting element assemblies having a 0.303 in. (7.70 mm) guide length survived the 2 million cycles, cutting element assemblies having a 0.267 in. (6.78 mm) guide length failed after an average of about 270,000 cycles, and cutting element assemblies having a 0.243 in. (6.17 mm) guide length failed after an average of about 47,000 cycles.

According to embodiments of the present disclosure, a cutting element in a cutting element assembly may have a guide length measured from a point of transition to the transition region to the retention feature that is longer than 0.3 in. (7.6 mm). In some embodiments, a cutting element may have a guide length greater than 0.35 in. (8.9 mm). In some embodiments, a cutting element may have a guide length greater than 0.4 in. (10 mm).

Types of cutting element assembly failure that may result from lost stability of the cutting element may include broken sleeves and loss of the cutting element. Cutting element assembly failure experienced during field testing and lab testing included broken sleeves in some of the cutting element assemblies broke and lost cutting elements.

According to embodiments of the present disclosure, displacement of a cutting element within a sleeve may be reduced, thereby improving cutting element stability, by reducing the tolerance between the cutting element and the sleeve. Tolerance between the cutting element and the sleeve may be described according to the amount of space, or gap, formed between the cutting element and the sleeve. In other words, cutting element assemblies of the present disclosure may have a diameter of a cutting element spindle less than the inner diameter of a sleeve along a shared axial position such that a gap is formed between the cutting element spindle and the sleeve. According to some embodiments of the present disclosure, the ratio of a gap formed between a cutting element spindle and a sleeve along a shared axial position and the diameter of the cutting element assembly at the same axial position may range from about 0.0005:1 to 0.02:1. By decreasing the gap formed between the cutting element and the sleeve, tolerance in a cutting element assembly may be reduced. Such a gap ratio may reduce the gap by greater than 20%, greater than 30%, or greater than 40% compared to conventional gaps, thereby improving the stability of the cutting element in some embodiments.

Cutting elements of the present disclosure may be retained within a sleeve to form a cutting element assembly, or may be retained directly to a cutter pocket formed in a cutting tool. According to some embodiments of the present disclosure having a cutting element retained within a sleeve, the cutting element assembly may include the cutting element partially within the sleeve, where the cutting element is retained within the sleeve by one or more retention features. The cutting element may include a cutting end, a spindle, and a retention feature disposed along the spindle side surface. The sleeve may have an inner diameter at an inner surface of the sleeve, an outer diameter at an outer surface of the sleeve, and a taper extending axially from a base of the sleeve a length along the sleeve, where the taper is formed by a decreasing outer diameter. The spindle may be within the sleeve such that the taper at least partially axially overlaps the retention feature.

Figure 14:
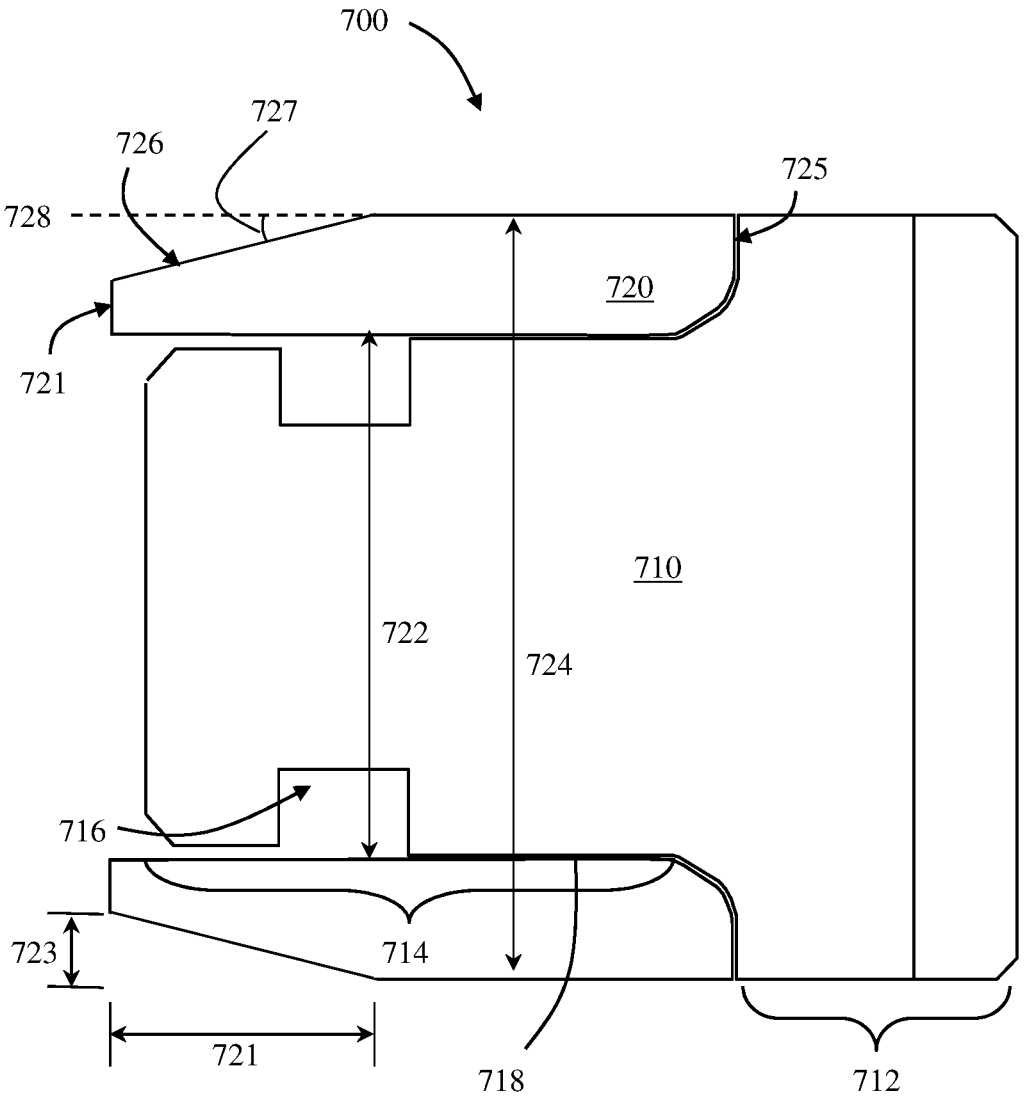
FIG. 14 is a cross-sectional view of a cutting element assembly according to embodiments of the present disclosure.

FIG. 14 shows a cross-sectional view of a cutting element assembly according to embodiments of the present disclosure, where a sleeve has a taper formed at its base. As shown, the cutting element assembly 700 has a cutting element 710 partially in a sleeve 720. The cutting element may include a cutting end 712, a spindle 714, and a retention feature 716 disposed along a spindle side surface 718. The sleeve 720 may have an inner diameter 722 at the inner surface of the sleeve and an outer diameter 724 at the outer surface of the sleeve. A taper 726 is formed in the sleeve 720 by an increasing outer diameter 724 that extends axially from a base 721 of the sleeve 720 towards a top surface 725 of the sleeve. The terms "base" and "top surface" may not always refer to the direction the terms describe, depending on the positioning of the cutting element assembly, but instead, the base of the sleeve refers to the surface of the sleeve axially farthest from the cutting end of an assembled cutting element, and the top surface of the sleeve refers to the surface of the sleeve interfacing with a radial bearing surface of the assembled cutting element. Further, as shown in FIG. 14, a sleeve outer diameter 724 may be substantially constant from the top surface 725 to the taper 726, at which point the outer diameter 724 may gradually decrease to the base 721. The inner diameter 722 of the sleeve may be substantially constant along its length. However, in some embodiments, a sleeve may have one or more retention features formed along its inner surface, where the inner diameter may vary at the one or more retention features.

Figure 16:
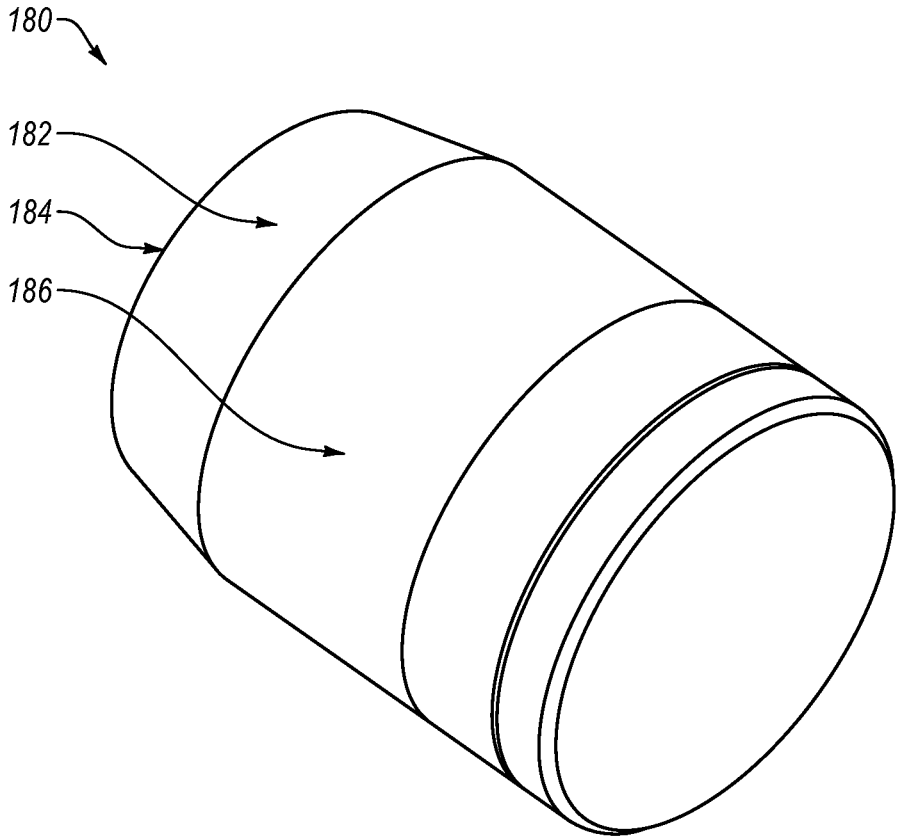
FIG. 16 is a perspective view of a cutting element assembly having a taper formed on the sleeve.

The taper 726 extends a length 721 along the sleeve 720, where the taper length is measured along the axial length of the sleeve having a changing outer diameter 724, and a radial width 723, where the radial width is measured across the thickness of the sleeve 720. As shown in FIG. 16, the length of the taper 726 at least partially axially overlaps the retention feature 716 formed in the assembled cutting element 710. In other words, at least part of the taper 726 and at least part of the retention feature 716 share a common axial position. In some embodiments, a taper formed in a sleeve of a cutting element assembly may extend a length such that it overlaps an entire retention feature formed in a cutting element assembled to the sleeve. In other embodiments, a taper formed at the base of a sleeve may not share an axial position with a retention feature formed in a cutting element assembled to the sleeve. For example, a cutting element assembly may have a sleeve with a taper formed along its outer surface and a cutting element partially within the sleeve, where the taper extends a length from the base of the sleeve and a retention feature is formed along the cutting element at an axial distance from the base of the sleeve that is greater than the axial length of the taper.

The length 721 of the taper 726 may range from about ¼ (25%) of the length of the sleeve to about ½ (50%) of the length of the sleeve 720. In some embodiments, a taper length may be less than ¼ (25%) the length of the sleeve, and in some embodiments, a taper may be greater than ½ (50%) the length of the sleeve. The radial width 723 of the taper 726 may range from about ¾ (75%) to ¼ (25%) of the greatest thickness of the sleeve 720. In some embodiments, the radial width of a taper may be less than ¼ (25%) the greatest thickness of the sleeve, and in some embodiments, a taper may be greater than ¾ (75%) the greatest thickness of the sleeve.

Further, an angle 727 of the taper 726 may be measured with respect to a line 728 tangent with the sleeve outer surface at its largest outer diameter 724. The angle 727 of the taper 726 may depend on, for example, the thickness of the sleeve, the length of the sleeve, and the shape of the taper. For example, the shape of the taper shown in FIG. 16 is formed by a planar surface having a constant slope (i.e., the constantly decreasing outer diameter); however, in other embodiments, a taper may be formed by a curved or stepped surface having a varying slope. According to embodiments of the present disclosure, the taper may have an angle ranging from 0° to 90°. In some embodiments, the taper may have an angle ranging from 0° to 20°. In some embodiments, the taper may have an angle ranging from 10° to 15°.

Figure 15:
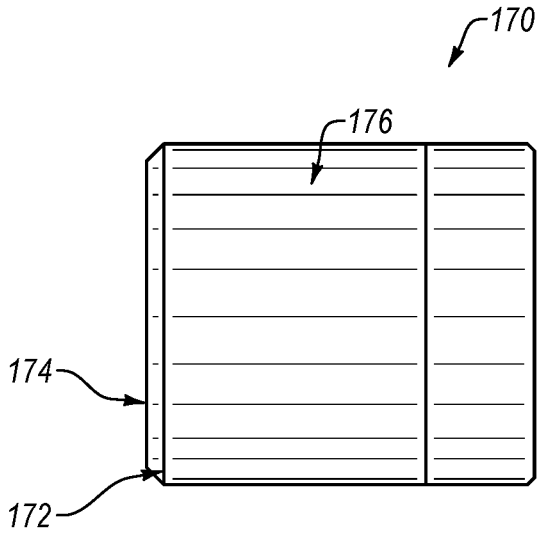
FIG. 15 is a side view of a cutting element assembly having a bevel formed on the sleeve.

As used herein, a taper is different from what may be referred to as a bevel or chamfer. For example, FIG. 15 shows a side view of a cutting element assembly 170 having a bevel 172 formed at the base 174 of its sleeve 176, and FIG. 16 shows a side view of a cutting element assembly 180 having a taper 182 formed at the base 184 of its sleeve 186 according to embodiments of the present disclosure. The taper 182 may have an axial length that is greater than its radial width, while the bevel 172 may have a radial width that is equal to or relatively close in value to its axial length. In other words, the bevel 172 may have an angle formed with respect to a line tangent to the sleeve outer surface of about 45°, or in some embodiments, ranging between 40° and 50°. Thus, the size of the taper 182 may be described based on its axial length along the sleeve 186 outer surface, while the size of the bevel 172 may be described based on either its axial length or radial width. As shown in FIGS. 15 and 16, a taper 182 formed in a sleeve extends a greater axial length along the sleeve outer surface than a bevel 172. For example, while a bevel may have an axial length (and radial width) less than the thickness of the sleeve, a taper may have an axial length greater than the thickness of the sleeve. In some embodiments, a bevel may have an axial length within a range of less than 0.06 in. (1.5 mm), and in some embodiments, a taper may have an axial length greater than 0.2 in. (5 mm). According to embodiments of the present disclosure, a taper may have an axial length extending greater than 5% of the total length of the sleeve, greater than 10% of the total length of the sleeve, greater than 25% of the total length of the sleeve, greater than 50% of the total length of the sleeve, or greater than 75% of the total length of the sleeve. For example, the taper may have an axial length between 5 and 100% of the total length of the sleeve or in some embodiments, between 10 and 50% of the total length of the sleeve.

Providing tapers along the outer surface of a sleeve may allow for reduced spacing between cutting element assemblies, or an increased number of cutting element assemblies to be arranged on a cutting tool. For example, cutting element assemblies of the present disclosure having an increased length (due to the relatively large guide length of the cutting element) may be spaced apart on a cutting tool based on, for example, their position along the cutting tool, e.g., side rake angle and back rake angle, the material of the cutting tool, the size and type of the cutting tool, and, if any, the size of a taper formed along the outer surface of the sleeve, such that the cutting element assemblies do not contact each other and that there is sufficient material from the cutting tool surrounding them in order to hold them to the cutting tool.

According to embodiments of the present disclosure, a downhole cutting tool may include a tool body and at least two cutting element assemblies within cutter pockets formed on the tool body. The cutting element assemblies may be secured to the cutter pocket, for example, by brazing the sleeve to the cutter pocket, or by other means of attachment. Each cutting element assembly may include a sleeve having a taper extending an axial length from the sleeve base, where the taper is formed by a decreasing outer diameter of the sleeve. A cutting element may be partially within and retained to the sleeve by one or more retention features. The cutting element may have a longitudinal axis extending axially therethrough, a cutting end having a depth measured from a cutting face to a radial bearing surface, and a spindle axially separated from the cutting end by a transition region, where the spindle includes a spindle side surface and a retention feature disposed along the spindle side surface. The distance from the longitudinal axis at the cutting face of one cutting element assembly to the longitudinal axis at the cutting face of an adjacent cutting element assembly may be less than 3 times the radius of the cutting element assemblies.

Figure 17:
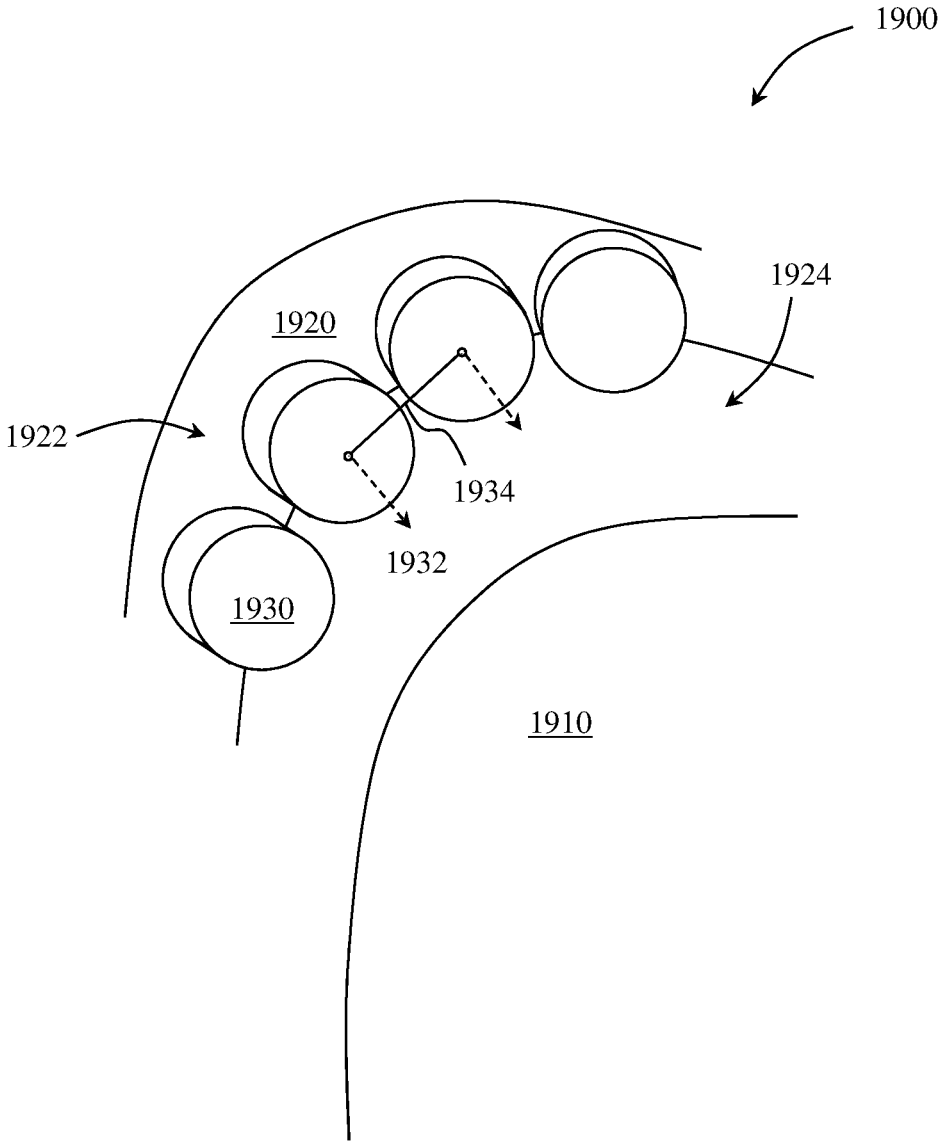
FIG. 17 is a partial view of a cutting tool according to embodiments of the present disclosure.

Referring now to FIG. 17, a partial view of a cutting tool according to embodiments of the present disclosure is shown. A drill bit 1900 has a body 1910 and a plurality of blades extending from the body 1910. Blade 1920 has at least two cutting element assemblies 1930 according to embodiments of the present disclosure in cutter pockets formed along a top face 1922 of the blade 1920 at the leading face 1924 of the blade 1920. The cutting element assemblies 1930 may have a cutting element partially in a sleeve, where the sleeve has a taper formed along the sleeve outer surface. The cutting element may have a longitudinal axis 1932 extending axially therethrough, a cutting end having a depth measured from a cutting face to a radial bearing surface, and a spindle rotatably retained within the sleeve. The distance 1934 between two adjacent cutting element assemblies 1930 may be less than 3 times the radius of the cutting element assemblies, where the distance 1934 is measured from the longitudinal axis 1932 at the cutting face of one cutting element assembly to the longitudinal axis 1932 at the cutting face of an adjacent cutting element assembly. According to some embodiments, the distance 1934 between two adjacent cutting element assemblies may be less than 2.5 times the radius of the cutting element assemblies. For example, the distance may be between 2 and 3 times the radius of the cutting element assemblies.

Figure 18:
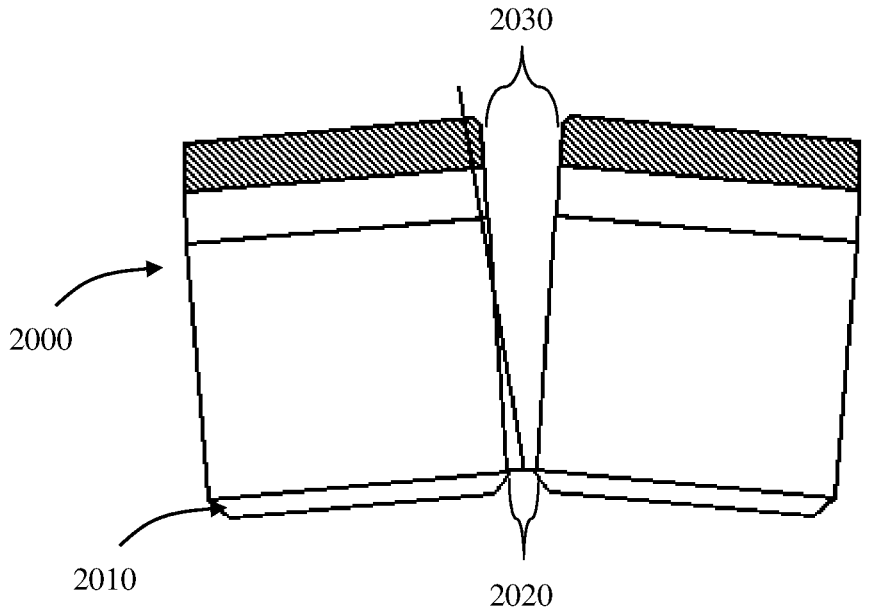
FIG. 18 is a side view of adjacent cutting element assemblies having a bevel formed on each sleeve.
Figure 19:
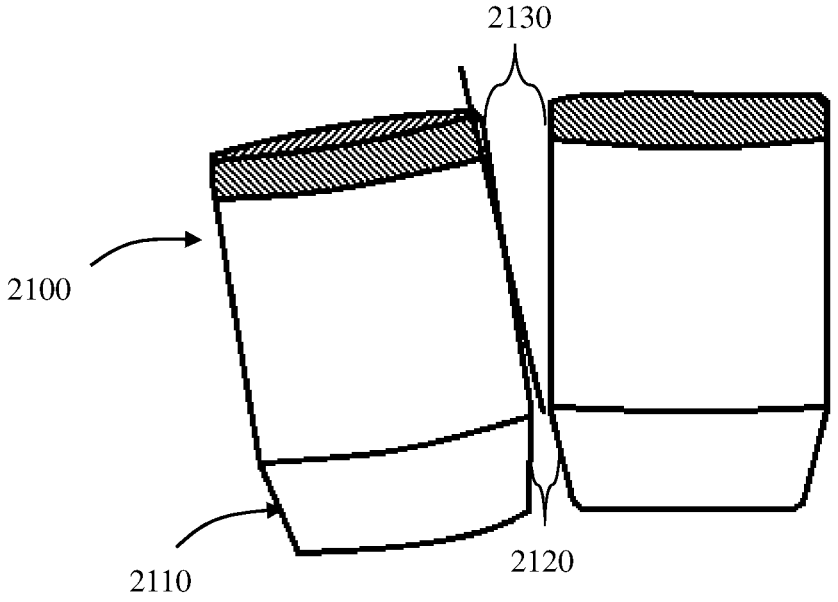
FIG. 19 is a side view of adjacent cutting element assemblies according to embodiments of the present disclosure, each cutting element assembling having a taper formed on a corresponding sleeve.

FIGS. 18 and 19 show cutting element assemblies 2000, 2100 spaced apart from each other along a blade. Specifically, FIG. 18 shows adjacent cutting element assemblies 2000 having a cutting element partially in a sleeve, where the sleeve has a bevel 2010 formed at the base of the sleeve, and FIG. 19 shows cutting element assemblies 2100 having a cutting element partially in a sleeve, where the sleeve has a taper 2110 formed along the sleeve outer surface. The smallest distance 2020 between the adjacent cutting element assemblies 2000 in FIG. 18 is measured between the closest points along the sleeve at the bevels 2010, while the greatest distance 2030 between the adjacent sleeves is measured opposite the bevels, near the cutting end. The smallest distance 2120 between the adjacent cutting element assemblies 2100 in FIG. 19 is measured between the closest points along the sleeve at the tapers 2110, while the greatest distance 2130 between the adjacent sleeves is measured opposite the tapers, near the cutting ends of the cutting element assemblies.

Adjacent cutting element assemblies 2000 having tapers may be spaced closer together than adjacent cutting element assemblies 2100 without tapers, and in some cases, even when cutting element assemblies having tapers are longer than cutting element assemblies without tapers. For example, as shown in FIGS. 18 and 19, adjacent cutting element assemblies 2100 have a total axial length greater than the total axial length of adjacent cutting element assemblies 2000, but may be spaced apart at equal or close to equal greatest distances. In the embodiments shown, adjacent cutting element assemblies 2000 may have a smallest distance 2020 of about 0.045 in. (1.14 mm) and a greatest distance 2030 of about 0.13 in. (3.30 mm), while adjacent cutting element assemblies 2100 may have a smallest distance 2020 of about 0.048 in. (1.22 mm) and a greatest distance 2030 of about 0.13 in. (3.30 mm). In other embodiments, adjacent cutting element assemblies having tapers may be spaced apart at lesser distances than adjacent cutting element assemblies without tapers, depending on the total axial length of the cutting element assemblies and their positioning on the blade. By forming tapers at the base of the cutting element assemblies, the cutting element assemblies may have a greater axial length (thereby improving cutting element stability) while also allowing for improved spacing between adjacent cutting element assemblies.

In some embodiments, an average reduction of about 21.5% in cutting element spacing, when comparing cutting element assemblies having the same axial length and same positioning (e.g., back rake and side rake) on the cutting tool, may be achieved by using tapers formed at the base end of the cutting element assembly sleeves. For example, in some embodiments, cutting element assemblies may have a spacing between an adjacent cutting element assembly, where the spacing is quantified by a spacing ratio of the distance between adjacent cutting element assemblies (as measured between the longitudinal axis at the cutting face of one cutting element assembly to the longitudinal axis at the cutting face of the adjacent cutting element assembly) to the axial length of the cutting element assemblies. In some embodiments having tapers formed at the base of the sleeve, adjacent cutting element assemblies may have a spacing ratio ranging between about 1:10 to 3:10 or in some embodiments, less than 2:10, while adjacent cutting element assemblies having the same axial length but without tapers may have a spacing ratio ranging, for example, between about 4:10 to 9:10.

Figure 20:
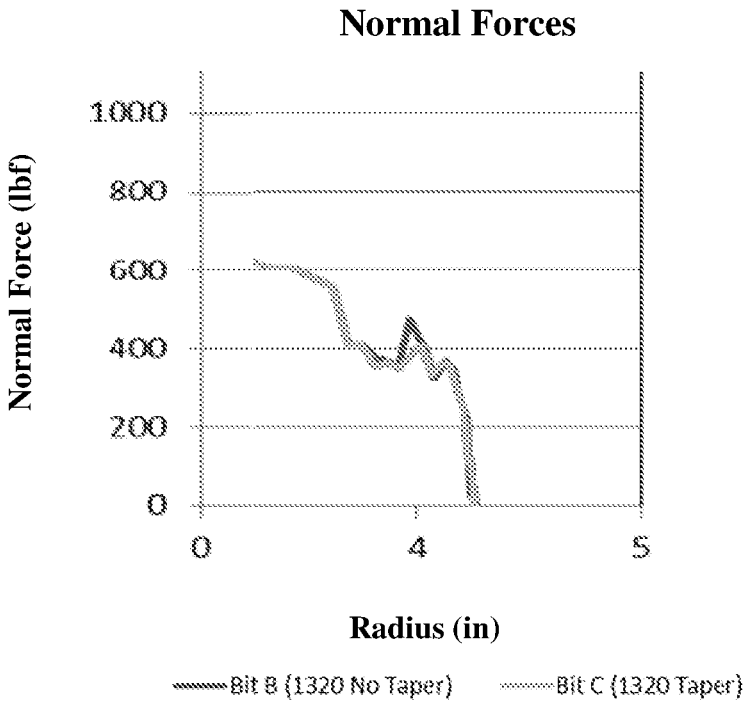
FIG. 20 is a graph of the normal forces from a bit having cutting element assemblies with a taper formed on each sleeve and a bit having cutting element assemblies without a taper.
Figure 21:
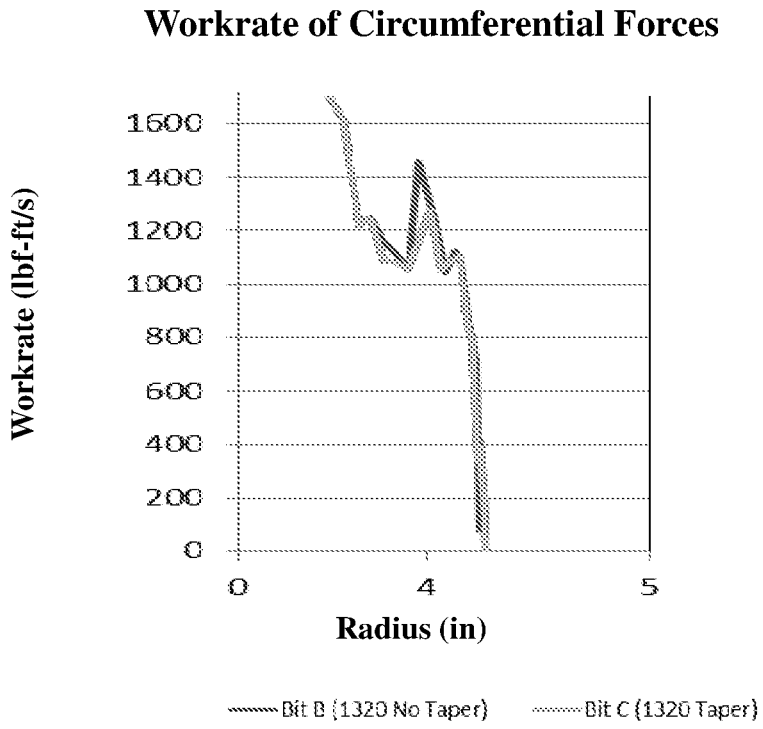
FIG. 21 is a graph of the workrate of circumferential forces from a bit having cutting element assemblies with a taper formed on each sleeve and a bit having cutting element assemblies without a taper.

Further, by spacing cutting element assemblies closer together, a reduction in normal and workrate cutting forces may be achieved. For example, as shown in FIGS. 20 and 21, cutting element assemblies having a taper formed at the base end of the sleeves encountered lower normal forces and lower workrate forces than cutting element assemblies without a taper positioned in the same area of the bit. When cutting element assemblies are spaced closer together, more cutting element assemblies may be assembled to a bit, and the cutting forces of the bit may be distributed to more cutting elements, thereby providing a reduced cutting force to each cutting element.

Cutting element assemblies having a sleeve with a taper formed at its base may or may not have additional features described herein used in combination with the tapered sleeve. For example, in some embodiments, a cutting element assembly may include a cutting element partially in a sleeve, where a tighter tolerance is formed between the cutting element and the sleeve and where a taper is formed along the outer surface of the sleeve. In some embodiments, a cutting element assembly may include a cutting element partially in a sleeve, where the cutting element has an increased guide length and where a taper is formed along the outer surface of the sleeve. In some embodiments, a cutting element assembly may include a cutting element partially in a sleeve, where a tighter tolerance is formed between the cutting element and the sleeve, where the cutting element has an increased guide length, and where a taper is formed along the outer surface of the sleeve. In some embodiments, a cutting element assembly may include a cutting element partially in a sleeve, where one or more seals are positioned between the cutting element and the sleeve, as described below, and where a taper is formed along the outer surface of the sleeve.

Cutting element assemblies having an increased guide length may be restricted in how close together they can be assembled to a cutting tool. As cutting element assemblies are spaced farther apart from each other, the decreased cutting element count may lead to an increased load distribution on each cutting element. By forming a taper along the sleeve of cutting element assemblies, the cutting element assemblies may be spaced closer together, thereby allowing for an increased cutting element count on a cutting tool. Reducing the gap between adjacent cutting element assemblies to provide an increased cutting element count may reduce the load on each cutting element, which may increase the life of the cutting tool.

Figure 23:
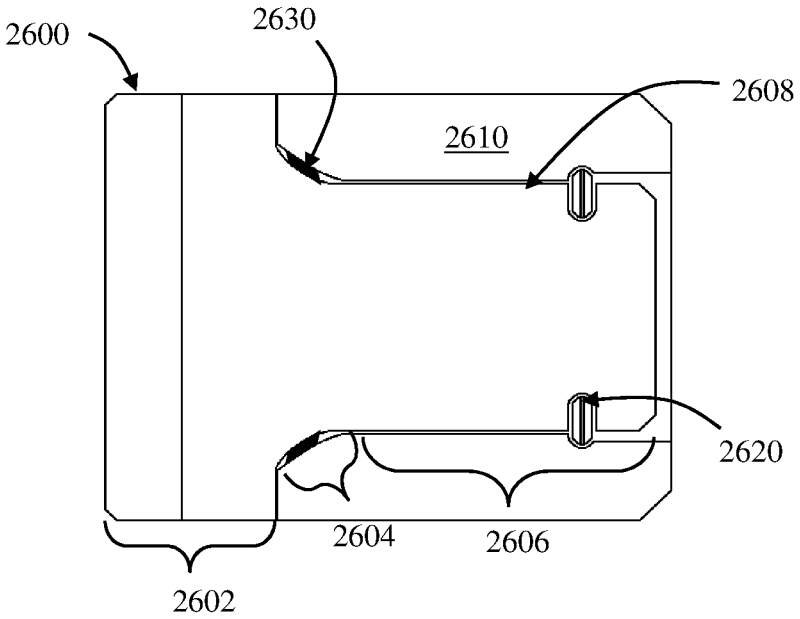
FIGS. 23 to 28 are cross-sectional views of cutting element assemblies according to embodiments of the present disclosure.

Referring now to FIG. 23, a cross-sectional view of a cutting element assembly according to embodiments of the present disclosure is shown. The cutting element assembly has a cutting element 2600 partially within a sleeve 2610. The cutting element 2600 has a cutting end 2602, a transition region 2604, and a spindle 2606, where the spindle 2606 is axially separated from the cutting end 2602 by the transition region 2604. A retention feature 2620 is disposed along a spindle side surface 2608, and at least one seal 2630 is between the sleeve 2610 and the cutting element 2600. The seal 2630 has a quadrilateral cross-sectional shape and extends around the circumference of the cutting element 2600. Seals having a quadrilateral cross-sectional shape may include, for example, a rectangle, trapezoid, or parallelogram cross-sectional shape. In one or more embodiments, the cross-section of the seal 2360 may have an aspect ratio of at least 3:1 or 4:1 in other embodiments. As shown, the seal 2630 is positioned within the transition region 2604 between the cutting element 2600 and the sleeve 2610. According to embodiments of the present disclosure, a seal may be positioned within grooves formed in one or both of the sleeve inner surface and the cutting element side surface, where the seal fits partially within the groove, or a seal may be positioned along a flat surface of one or both of the sleeve inner surface and the cutting element side surface. For example, as shown in FIG. 23, the cross-sectional profile of the transition region 2604 includes a planar surface, where the seal 2630 is disposed along the planar surface of the transition region 2604. The cross-sectional profile of the sleeve 2610 in the axial position corresponding with the cutting element transition region 2604 also includes a planar surface, where the seal 2630 is between the planar surfaces of the sleeve and cutting element within the transition region 2604.

Figure 24:
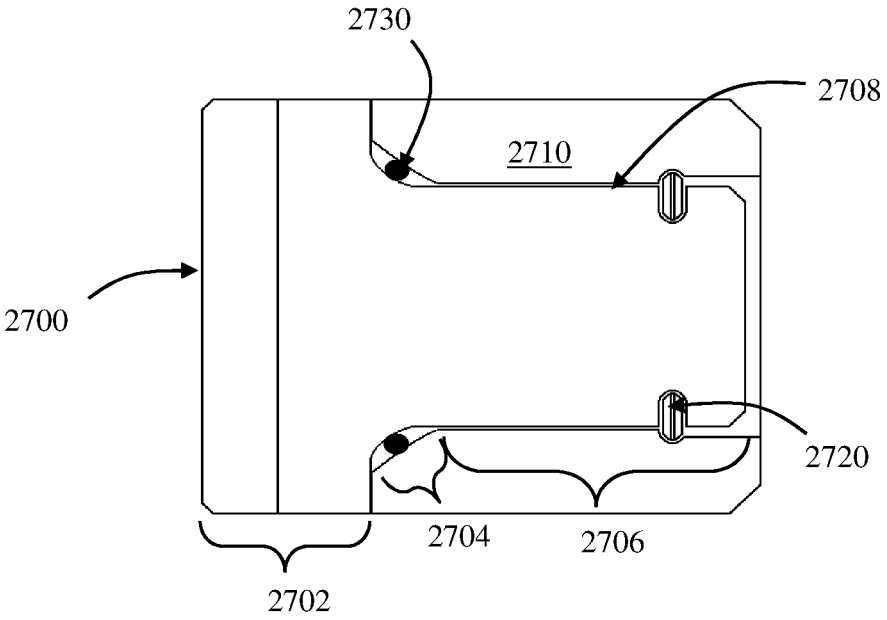

FIG. 24 shows a cross-sectional view of a cutting element assembly according to embodiments of the present disclosure. The cutting element assembly is similar to that disclosed in FIG. 23 except that the seal 2730 has a circular cross-sectional shape and extends around the circumference of the cutting element 2700. Further, the cross-sectional profile of the sleeve 2710 in the axial position corresponding with the cutting element transition region 2704 includes a surface having a planar cross-sectional profile, where the seal 2730 is between the sleeve surface with a planar cross-sectional profile and the transition region 2704 of the cutting element.

Figure 25:
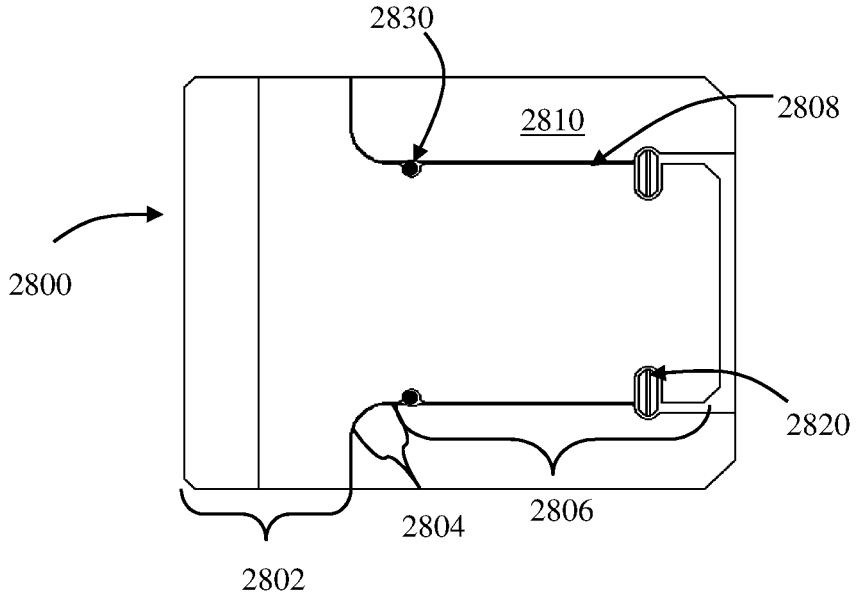
Figure 27:
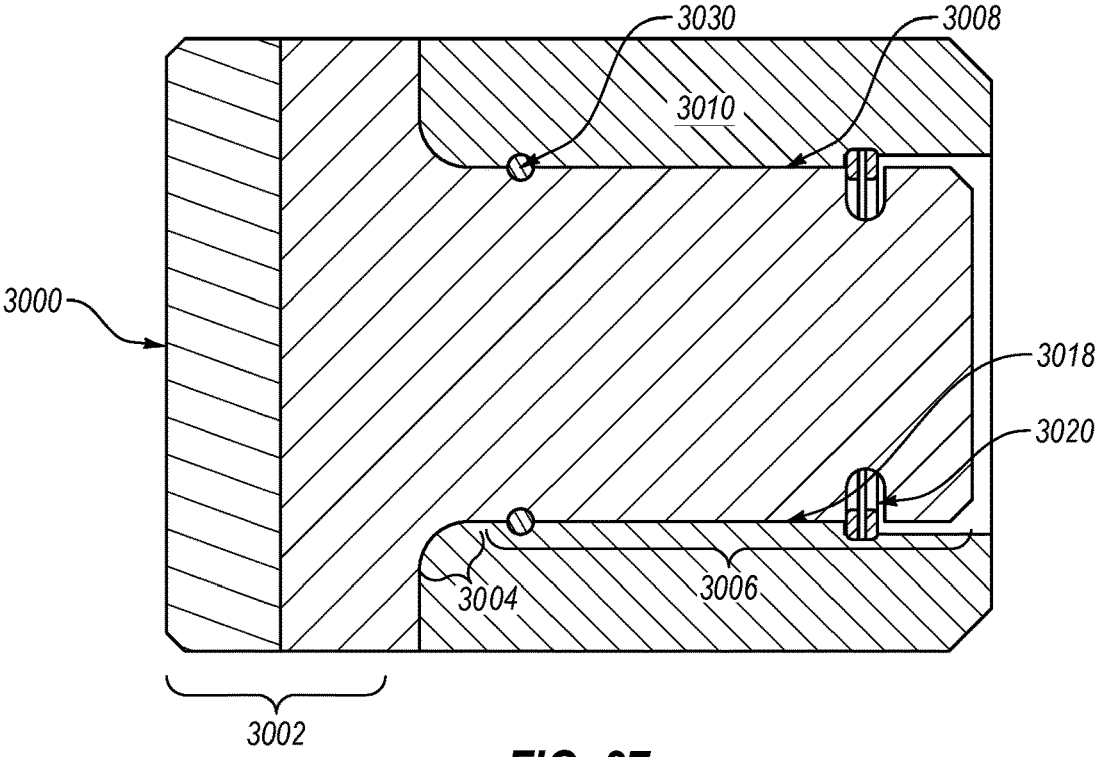

FIG. 25 shows a cross-sectional view of another cutting element assembly according to embodiments of the present disclosure. The cutting element assembly has a cutting element 2800 partially within a sleeve 2810. The cutting element 2800 has a cutting end 2802 axially separated from a spindle 2806 by a transition region 2804. A retention feature 2820 is disposed along a spindle side surface 2808, and at least one seal 2830 is between the sleeve 2810 and the cutting element 2800. In particular, the seal 2830 is within a groove formed around the side surface 2808 of the spindle 2806 portion of the cutting element 2800 and protrudes from the groove to contact an inner surface of the sleeve 2810 having a planar cross-sectional profile. However, in other embodiments, the seal may protrude from a groove in the cutting element side surface to fit partially within a corresponding groove formed in the inner surface of the sleeve, such as shown in FIG. 27 and described below. The seal 2830 has a circular cross-sectional shape and extends around the circumference of the cutting element 2800.

Figure 26:
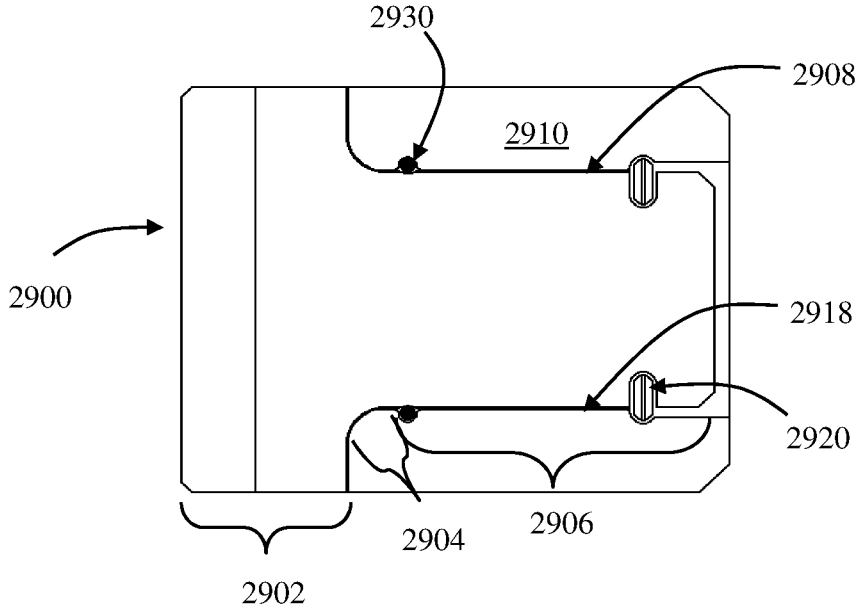

FIG. 26 shows a cross-sectional view of another cutting element assembly according to embodiments of the present disclosure. The cutting element assembly has a cutting element 2900 partially within a sleeve 2910. The cutting element 2900 has a cutting end 2902 axially separated from a spindle 2906 by a transition region 2904. A retention feature 2920 is disposed along a spindle side surface 2908, and at least one seal 2930 is between the sleeve 2910 and the cutting element 2900. In particular, the seal 2930 is within a groove formed around the inner surface 2918 of the sleeve 2910 and protrudes from the groove to contact the spindle side surface 2908 having a planar cross-sectional profile. The seal 2930 has a circular cross-sectional shape and extends around the circumference of the cutting element 2900.

According to embodiments of the present disclosure, one or more seals may be between a cutting element and a sleeve along at least one surface of the cutting element and/or sleeve having a planar cross-sectional profile, such as shown in FIGS. 23-26. However, in some embodiments, one or more seals may be between sleeve and cutting element surfaces having a non-planar cross-sectional profile, e.g., between corresponding grooves formed in sleeve and cutting element. For example, FIG. 27 shows a cross-sectional view of another cutting element assembly according to embodiments of the present disclosure. The cutting element assembly has a cutting element 3000 partially within a sleeve 3010. The cutting element 3000 has a cutting end 3002 axially separated from a spindle 3006 by a transition region 3004. A retention feature 3020 is disposed along a spindle side surface 3008, and at least one seal 3030 is between the sleeve 3010 and the cutting element 3000. In particular, the seal 3030 is between corresponding grooves formed around the inner surface 3018 of the sleeve 3010 and the spindle side surface 3008. The seal 3030 has a circular cross-sectional shape and extends around the circumference of the cutting element 3000.

One or more seals may be between a sleeve and a cutting element of a cutting element assembly, where the seal may have a circular cross-sectional shape, a quadrilateral cross-sectional shape, or other shape, such as a polygonal shape or an irregular shape including planar and/or non-planar sides. In some embodiments, a seal may have a cross-sectional shape that is different than the cross-sectional shape of the space formed between a sleeve and cutting element in which the seal is disposed. In some embodiments, a seal may have a cross-sectional shape corresponding with the space formed between a sleeve and cutting element in a cutting element assembly in which the seal is disposed, where the space may have a circular, polygonal, or irregular shaped cross-section.

Figure 28:
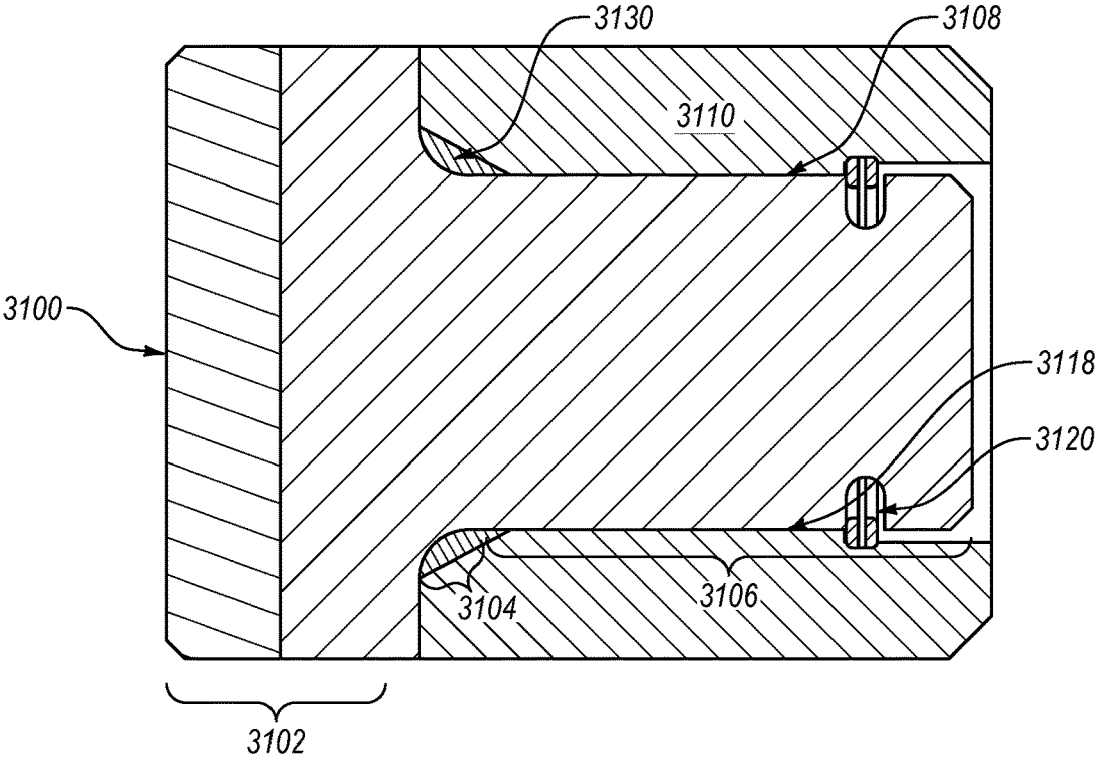

For example, FIG. 28 shows a cross-sectional view of another cutting element assembly according to embodiments of the present disclosure. The cutting element assembly has a cutting element 3100 partially within a sleeve 3110. The cutting element 3100 has a cutting end 3102 axially separated from a spindle 3106 by a transition region 3104. A retention feature 3120 is disposed along a spindle side surface 3108 to axially retain the cutting element within the sleeve. A seal 3130 is in a space between the sleeve 3110 and the cutting element 3100, where the seal 3130 and the space in which the seal is located have corresponding cross-sectional shapes. In particular, the seal 3130 and corresponding space between the sleeve 3110 and cutting element 3100 have an irregular cross-sectional shape, including a planar surface and a curved surface. As shown, the seal 3130 may be in a space that extends axially through the entire transition region 3104 of the cutting element assembly and partially into the spindle 3106 region. The seal 3130 fills the space and thus also extends axially through the transition region and partially into the spindle region, contacting the cutting element outer surface along the transition region 3104 and part of the spindle side surface. In such illustrated embodiment, the cutting element 3100 and the sleeve 3110 have differing geometries transitioning between the radial bearing surfaces and side surfaces, and the seal 3130 fills the volume of space created by such differing geometries. According to other embodiments, a seal may be in one region of the cutting element assembly, e.g., the transition region or the spindle region. In some embodiments, more than one seal may be in a cutting element assembly where at least one seal is in one or more regions of the cutting element assembly, e.g., one seal in the transition region and one seal in the spindle region or two seals in the spindle region, or other combinations of seal placements.

Figure 29:
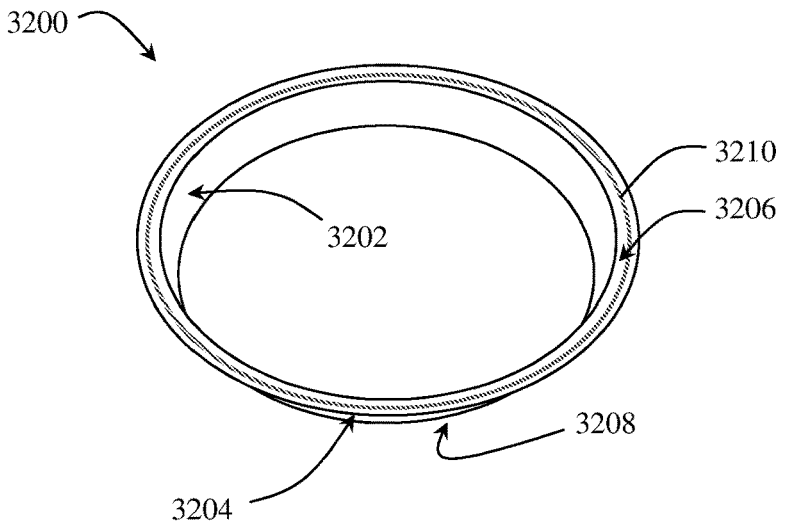
FIG. 29 is a perspective view of a seal according to embodiments of the present disclosure.

FIG. 29 shows a perspective view of a seal according to embodiments of the present disclosure. The seal 3200 has an inner surface 3202, an outer surface 3204 opposite the inner surface, a top surface 3206 and a bottom surface 3208 opposite the top surface. Each of the inner surface 3202, outer surface 3204, top surface 3206 and bottom surface 3208 have a planar cross-sectional shape, where the cross-sectional shape of the seal is rectangular. However, as mentioned above, seals may have other cross-sectional shapes, including, for example, polygonal shapes having three, four, five or more sides, circular or elliptical shapes, or irregular shapes having multiple non-planar sides or a combination of planar and non-planar sides. Different shapes of seals may be used to fit within different shapes of spaces formed between a cutting element and a sleeve or outer support of a cutting element assembly.

Further, seals may be made of different materials including, for example, graphite, wear resistant fabric infused with low friction materials, e.g., graphite and polytetrafluoroethylene (PTFE), other polymers having similar properties to PTFE, rubber and rubber-like materials, e.g., synthetic materials having similar properties to rubber, low friction coefficient metal, castable or deformable materials, or combinations of such materials. For example, as shown in FIG. 29, the seal 3200 may be made of rubber, rubber-like material or polymer and have a metal core 3210. In some embodiments, such as shown in FIG. 28, a seal 3130 may be made of a castable or deformable material, such as castable elastomers.

Cutting element assemblies may be subject to impact forces and damage due to lateral movement during drilling, which may lead to fracture or brakeage. Further, some cutting element assemblies may be subject to damage from formation cuttings getting between the cutting element and sleeve or outer support, which may accelerate wear between the cutting element and sleeve or outer support components. For example, debris may enter the cutting element assembly and wear the sleeve inner surface. Including one or more seals between a cutting element and sleeve or outer support may help dampen impact forces on the cutting element during drilling as well as reduce the cutting element lateral movement. Using one or more seals between a cutting element and sleeve or outer support may also help to prevent debris from entering the cutting element assembly. Further, in embodiments having grease or lubricant used between a cutting element and a sleeve or outer support, for example to help rotation of the cutting element within the sleeve or outer support, one or more seals may be used to seal the grease within the cutting element assembly.

Furthermore, the transition region of cutting element assemblies of the present disclosure may be designed to provide the cutting element with improved strength and impact resistance. For example, according to embodiments of the present disclosure, a cutting element assembly may include a cutting element partially within an outer support and axially retained within the outer support by a retention feature between the cutting element and outer support. The cutting element may have a cutting end extending a depth from a cutting face to an interface surface opposite from the cutting face, a spindle, where a spindle diameter of a spindle side surface is less than a cutting end diameter of a cutting end side surface, a transition region having a transition surface extending from a point of transition from the interface surface to a point of transition from the spindle side surface, where a cross-sectional profile of the transition surface has at least one planar surface, and a taper line measured from the point of transition from the interface surface to the point of transition from the spindle side surface, where the taper line forms a taper angle ranging from 5° to 85° with a line tangent to the spindle side surface. In some embodiments, cutting elements having a transition surface with a planar cross-sectional surface closest to the spindle at an angle between 5° and 85° from a line tangent to the spindle side surface may have improved strength and impact resistance when compared with cutting elements having a radiused transition surface.

Because the strength of a cutting element may depend on the strength of its transition region, transition surface design may be used to reduce cutting element failure. By providing cutting elements with an improved transition surface design, such as according to embodiments of transition surfaces disclosed herein, the overall strength of the cutting element may also be improved.

Figure 30:
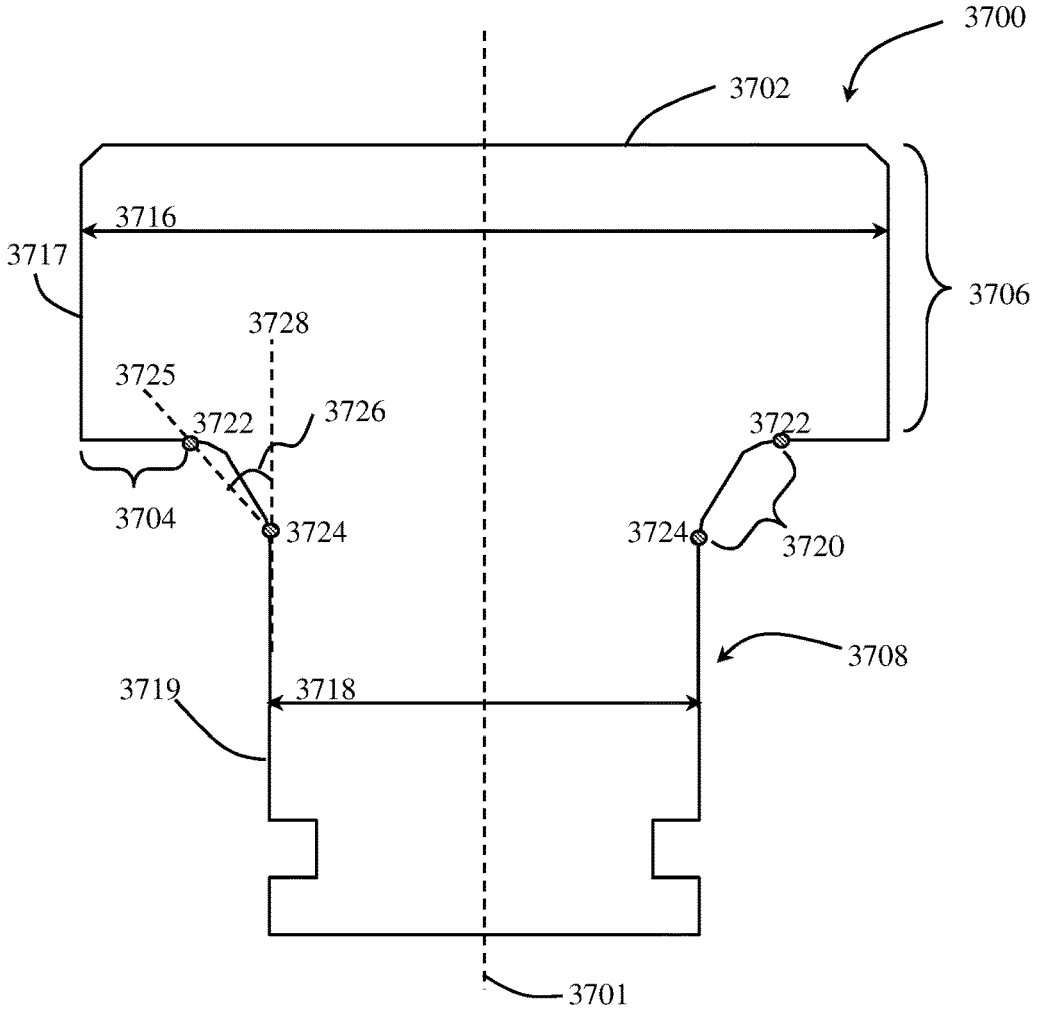
FIG. 30 is a cross-sectional view of a cutting element according to embodiments of the present disclosure.

Referring now to FIG. 30, a cutting element 3700 according to embodiments of the present disclosure is shown. The cutting element 3700 has a cutting face 3702, an interface surface 3704 (also referred to as a radial bearing surface upon interfacing with a sleeve) opposite from the cutting face 3702, a cutting end 3706 extending a depth from the cutting face 3702 to the interface surface 3704, a spindle 3708, and a longitudinal axis 3701 extending through the length of the cutting element 3700.

The interface surface 3704 may interface with a top side of a sleeve (shown as 21 in FIG. 3) to form a radial bearing between the cutting element and the sleeve. A spindle diameter 3718 at the spindle side surface 3719 is less than a cutting end diameter 3716 defined by the cutting end side surface 3717. The cutting element 3700 has a transition surface 3720 extending from a point 3722 of transition from the interface surface to a point 3724 of transition from the spindle side surface 3719. The point 3722 of transition from the interface surface may be defined as the point at which the slope of the line tangent to the interface surface changes. In other words, a line tangent to the interface surface 3704 may have a substantially constant slope, where the interface surface extends from a cutting end outer surface to the point 3722 at which the slope changes. The point 3724 of transition from the spindle side surface 3719 may be defined as the point at which the slope of the line tangent to the spindle side surface 3719 changes. In other words, a line tangent to the spindle side surface 3719 may have a substantially constant slope, wherein the spindle side surface 3719 extends from a base to the point 3724 at which the slope changes. Further, the transition surface 3720 extends around the circumference of the cutting element 3700, although because FIG. 30 is a cross-sectional view of the cutting element 3700, the cross-sectional shape of the transition surface 3720 is shown rather than its extension around the cutting element 3700.

A taper line 3725 is measured from the point 3722 of transition from the interface surface 3704 to the point 3724 of transition from the spindle side surface 3719. According to some embodiments, a taper line may substantially correspond with the transition surface, such as when the transition surface has a substantially planar cross-sectional profile. According to other embodiments, such as shown in FIG. 30, the taper line 3725 may have a different shape than the transition surface 3720. The taper line 3725 is at a taper angle 3726 from a line 3728 tangent to the spindle side surface 3719. Further, in embodiments having the line tangent to the spindle side surface parallel with the cutting element longitudinal axis, the taper line angle may be measured with respect to either the line tangent to the spindle side surface or the longitudinal axis.

The taper line angle 3726 may range from 5° to 85°. According to some embodiments of the present disclosure, the taper line angle may be within a range having upper, lower, or both upper and lower limits including any of 5°, 10°, 15°, 20°, 25°, 30°, 35°, 45°, 60°, 75°, or 85°. In particular example embodiments, the taper line angle 3726 may range from 25° to 35°. Further, in some embodiments, the taper angle 3726 may be designed based on the radial length of the interface surface 3704, the total length of the cutting element 3700 and/or the axial length of the spindle 3708. For example, in some embodiments, a transition surface may have a taper angle of greater than 30° when the ratio of the radial length of the interface surface to the total length of the cutting element is greater than 1:8.

A transition surface may include at least one planar surface and/or at least one non-planar surface in rotated profile view. For example, as shown in FIG. 30, the cross-sectional profile of the transition surface 3720 may include a curved surface transitioning from the interface surface 3704 to a planar surface.

Figure 31:
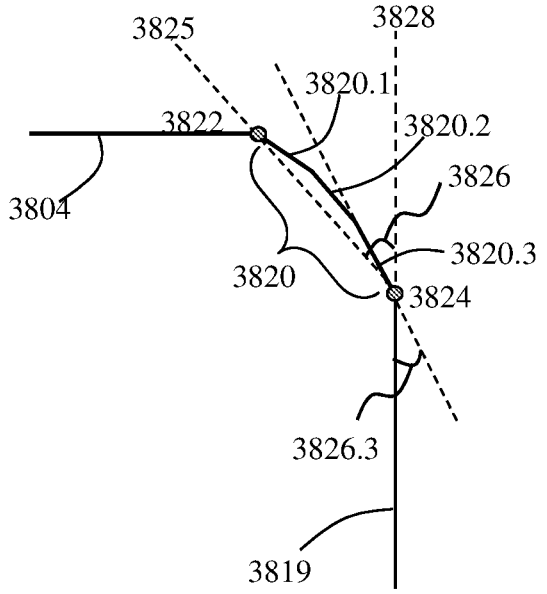
FIGS. 31 to 33 are partial cross-sectional views of cutting elements according to embodiments of the present disclosure.

In some embodiments, a transition surface may include a cross-sectional shape having more than one planar surface transitioning at angled connections. For example, FIG. 31 shows a partial cross-sectional view of a cutting element having a transition surface 3820 formed of more than one planar surface 3820.1, 3820.2, 3820.3. As shown, the planar surface 3820.1 may transition at an angle from a point 3822 of transition from the cutting element interface surface 3804, the planar surface 3820.2 may transition at an angle from the planar surface 3820.1, and the planar surface 3820.3 may transition at an angle from the planar surface 3820.2 to an angle at the point 3824 of transition from the spindle side surface 3819. The transition surface 3820 angle of orientation may be defined by the taper angle 3826 formed between a taper line 3825 extending from the point 3824 of transition from the spindle side surface 3819 to the point 3822 of transition from the interface surface 3804 and a line 3828 tangent to the spindle side surface 3819. Further, as shown, the planar surface 3820.3 closest to the spindle side surface 3819 may extend at an angle 3826.3 with respect to a line tangent to the spindle side surface. According to embodiments of the present disclosure, the angle 3826.3 may range from 25 to 35°.

According to some embodiments of the present disclosure, a planar surface closest to the spindle side surface may form a majority of a transition surface. In such embodiments, the angle of the planar surface with respect to a line tangent to the spindle side surface may be within 1%, 5%, 10%, or 15% range of difference from a taper angle formed between a taper line and the line tangent to the spindle side surface.

Figure 32:
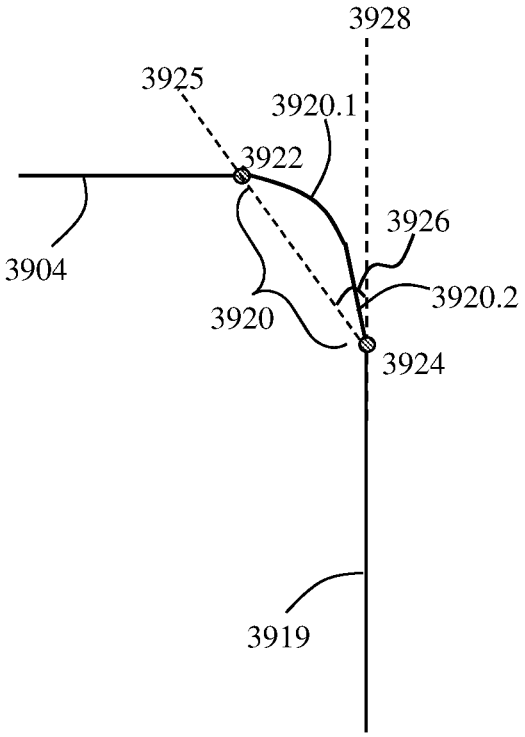

FIG. 32 shows a partial cross-sectional view of a cutting element having a transition surface 3920 formed of a non-planar surface 3920.1 and a planar surface 3920.2 according to other embodiments of the present disclosure. As shown, the non-planar surface 3920.1 may transition at an angle from a point 3922 of transition from the cutting element interface surface 3904 and the planar surface 3920.2 may transition at an angle from the non-planar surface 3920.1 to an angle at the point 3924 of transition from the spindle side surface 3919. The transition surface 3920 angle of orientation may be defined by the angle 3926 formed between a taper line 3925 extending from the point 3924 of transition from the spindle side surface 3919 to the point 3922 of transition from the interface surface 3904 and a line 3928 tangent to the spindle side surface 3919. Embodiments of the present disclosure may have transition surfaces formed of various combinations of one or more planar surfaces and/or one or more non-planar surfaces, wherein the angle of orientation of the transition surface is defined by the angle formed between a taper line and a line tangent to the spindle side surface.

Figure 33:
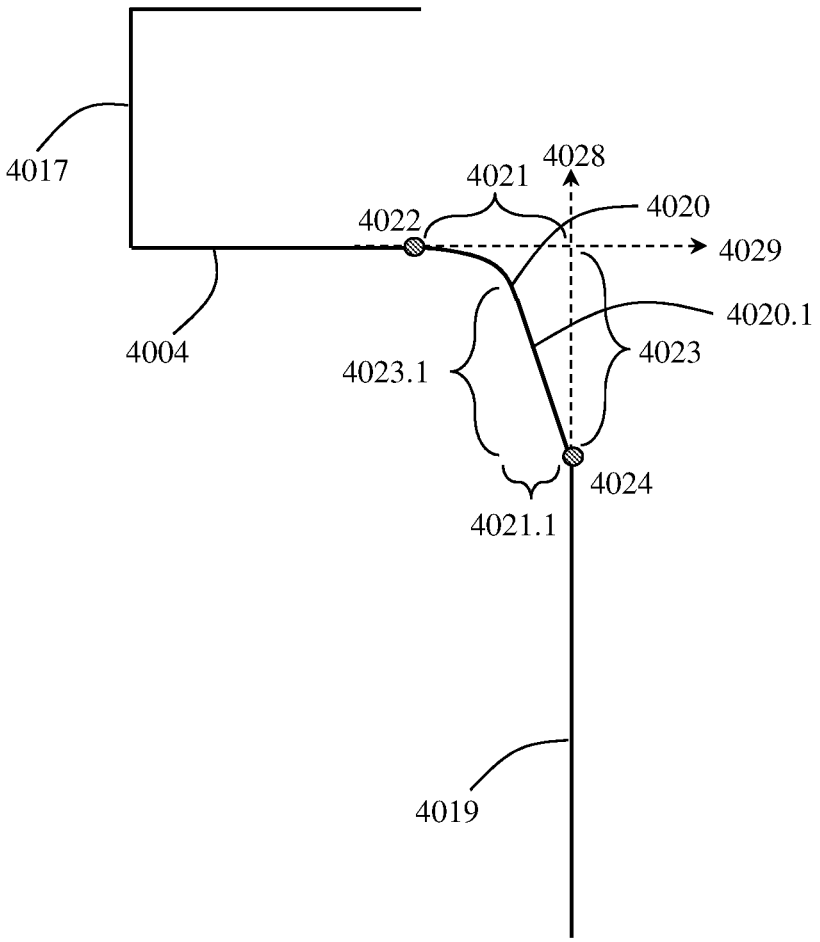

Further, the size of a transition surface, such as radial and axial lengths of extension, may be designed based on dimensions of the cutting element. For example, referring to FIG. 33, a partial cross-sectional view of a cutting element is shown, wherein the cutting element has an interface surface 4004 extending a distance radially inward from a cutting end side surface 4017, a spindle side surface 4019, and a transition surface 4020 extending from a point 4022 of transition from the interface surface 4004 to a point 4024 of transition from the spindle side surface 4019. The transition surface 4020 has a cross-sectional shape with at least one planar surface 4020.1, a radial length of extension 4021 and an axial length of extension 4023. The radial length of extension 4021 is measured from the point 4022 of transition from the interface surface 4004 to the line 4028 tangent to the spindle side surface 4019. In other words, the radial length of extension 4021 is equal to D−(T+J), wherein D is the outer diameter of the cutting element, T is the radial length of the substantially planar surface of interface surface, and J is the diameter of the lower spindle portion axially above the retention cavity. The axial length of extension 4023 is measured from the point 4024 of transition from the spindle side surface 4019 to the line 4029 tangent to the interface surface 4004. According to embodiments of the present disclosure, the radial length of extension 4021 and/or the axial length of extension 4023 of the transition surface 4020 may be designed based on the radial distance of the interface surface 4004 and/or the axial length of the spindle.

The planar surface 4020.1 may extend a radial length 4021.1 and axial length 4023.1, wherein the radial length 4021.1 of the planar surface 4020.1 is less than the radial length of extension 4021 of the transition surface 4020 and the axial length 4023.1 of the planar surface 4020.1 is less than the axial length of extension 4023 of the transition surface 4020. According to embodiments of the present disclosure, a transition surface may include a cross-sectional shape with a planar surface, wherein the planar surface has a radial length ranging from 10% to 100% of the radial length of extension of the transition surface and an axial length ranging from 20% to 100% of the axial length of extension of the transition surface. In some embodiments, a transition surface may include cross-sectional shape with a planar surface, wherein the planar surface has an axial length ranging from at least 50% of the axial length of extension of the transition surface.

Figure 34:
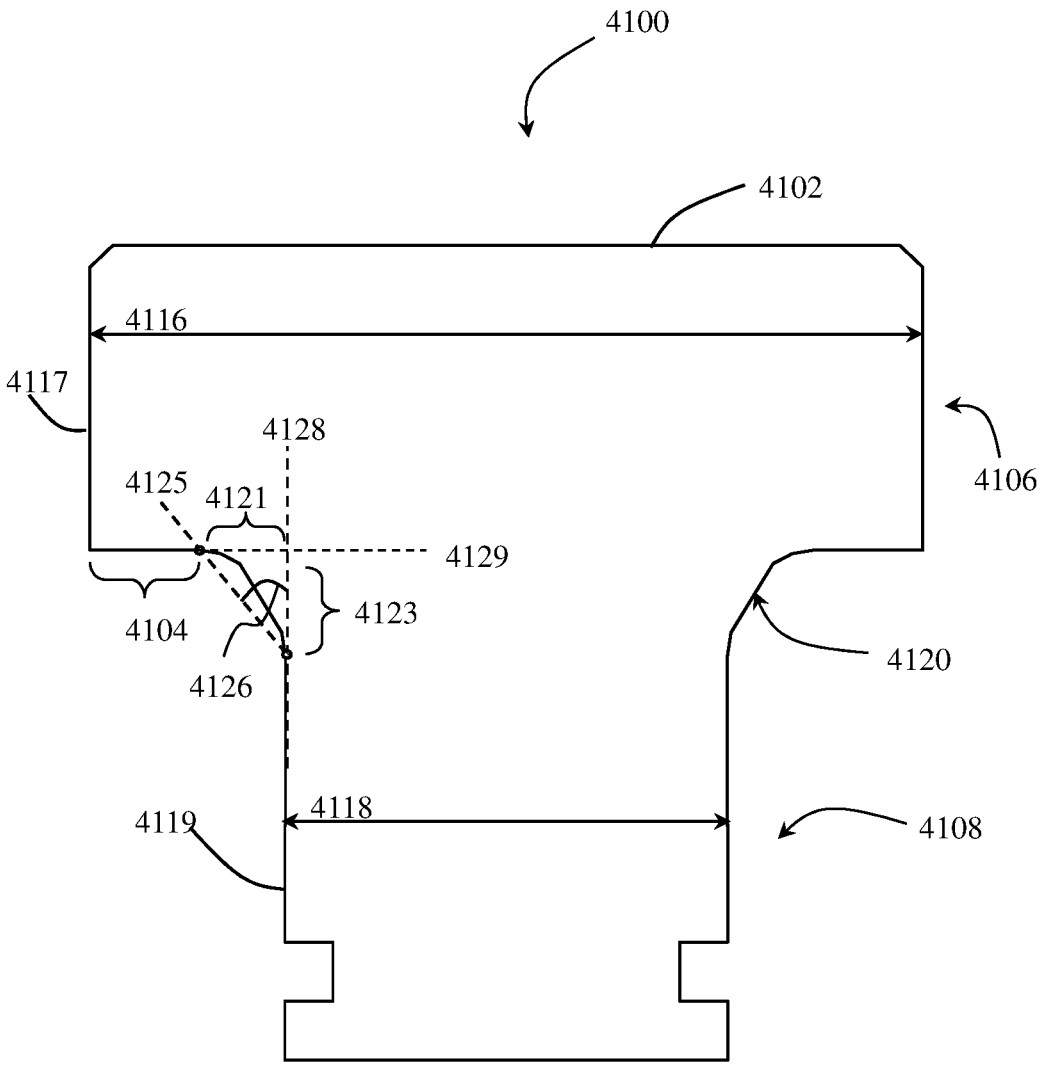
FIG. 34 is a cross-sectional view of a cutting element according to embodiments of the present disclosure.

Referring now to FIG. 34, a cutting element 4100 according to embodiments of the present disclosure may have a cutting end 4106, a spindle 4108, wherein the spindle diameter 4118 is less than the cutting end diameter 4116, and a transition surface 4120 connecting the cutting end 4106 to the spindle 4108. The cutting end 4106 is defined by a plurality of outer surfaces, including a cutting face 4102, a cutting end side surface 4117, and an interface surface 4104 opposite from the cutting face 4102. A taper line 4125 is measured from the intersection of the interface surface 4104 and transition surface 4120 to the intersection of the spindle outer surface 4119 and transition surface 4120 and extends an angle 4126 from a line 4128 tangential to the spindle outer surface 4119. Further, the transition surface 4120 has a radial length of extension 4121 and an axial length of extension 4123, wherein the radial length of extension 4121 is measured from the interface surface 4104 to a line 4128 tangent to the spindle side surface 4119 and the axial length of extension 4123 is measured from the spindle side surface 4119 to a line 4129 tangent to the interface surface 4104.

According to embodiments of the present disclosure, the radial length of extension 4121 may range from 25 to 100% of the radial distance of the interface surface 4104. In some embodiments, the radial length of extension 4121 may range from 1/20 (5%) to 1/10 (10%) of the spindle diameter 4118.

The axial length of extension 4123 of the transition surface may range from 50% to 150% of the radial distance of the interface surface 4104. In some embodiments, the axial length of extension 4123 may be less than 1/10 (10%) of the length of the spindle 4108.

Figure 35:
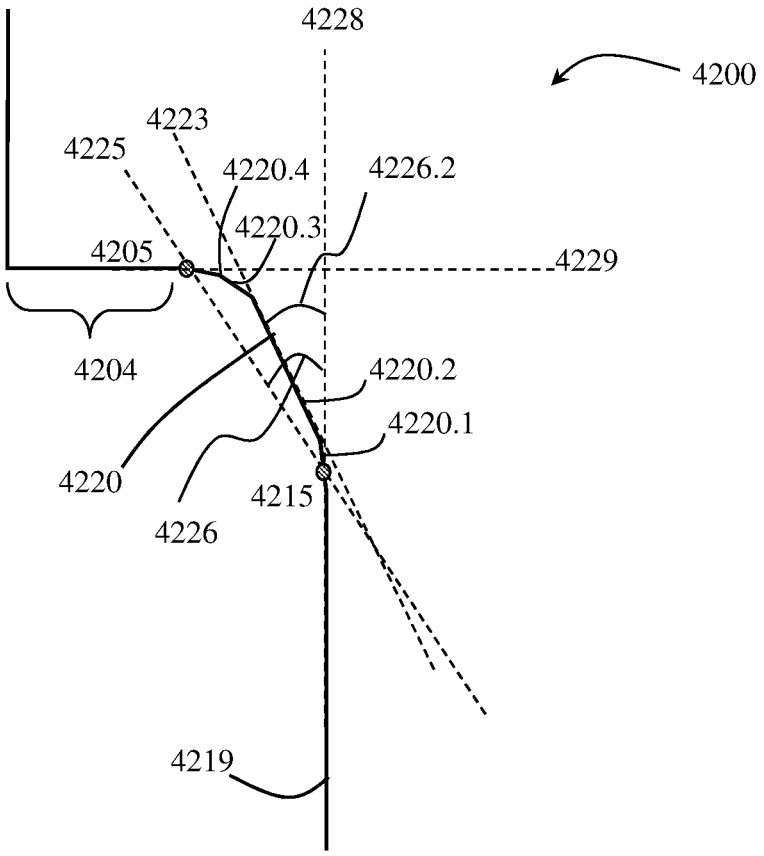
FIG. 35 is a partial cross-sectional view of a cutting element according to embodiments of the present disclosure.

Referring now to FIG. 35, a partial cross-sectional view of a cutting element 4200 according to embodiments of the present disclosure is shown. The cutting element has a cutting end, a spindle, and a transition surface 4220 extending from an interface surface 4204 of the cutting end to a spindle side surface 4219. A taper line 4225 is measured between the point 4205 of transition from the interface surface 4204 to the transition surface 4220 and the point 4215 of transition from the spindle side surface 4219 to the transition surface 4220. The taper line 4225 is at a taper angle 4226 from a line 4228 tangent to the spindle side surface, wherein the taper angle 4226 ranges from 5° to 85°. As shown, the transition surface 4220 may have a cross-sectional shape including planar and non-planar surfaces 4220.1, 4220.2, 4220.3, 4220.4. Particularly, the transition surface 4220 has a non-planar surface 4220.1 extending from the point 4215 of transition from the spindle side surface 4219 to a planar surface 4220.2, a planar surface 4220.3 extending at an angle from the planar surface 4220.2, and a curved surface 4220.4 connecting the planar surface 4220.3 to the point 4205 of transition from the interface surface 4204. A line 4223 tangent to the planar surface 4220.2 closest to the spindle side surface extends at an angle 4226.2 from the line 4228 tangent to the spindle side surface 4219. In the embodiment shown, a taper line 4225 may not align with the transition surface 4220; however, in other embodiments, the taper line may substantially align with the transition surface. For example, as shown in FIG. 35, the angle 4226.2 of the planar surface closest to the spindle side surface 4219 is less than the taper angle 4226. According to embodiments of the present disclosure, a planar surface closest to the spindle may have a tangent line forming an angle with a line tangent to the spindle side surface ranging between 5° and 85°. In some embodiments, a planar surface closest to the spindle may have a tangent line forming an angle with a line tangent to the spindle side surface ranging between 25° and 35°.

A transition surface may have a cross-sectional shape with a planar surface that is located closest to the spindle that extends directly from the point of transition from the spindle side surface, or that transitions to the point of transition from the spindle side surface with a curved surface. For example, as shown in FIG. 35, a curved surface 4220.1 connects the planar surface 4220.2 closest to the spindle to the point 4215 of transition from the spindle side surface. FIGS. 31 and 32 show embodiments with a planar surface 3820.3, 3920.2 closest to the spindle side surface 3819, 3919 that extends directly from the spindle side surface 3819, 3919.

Figure 36:
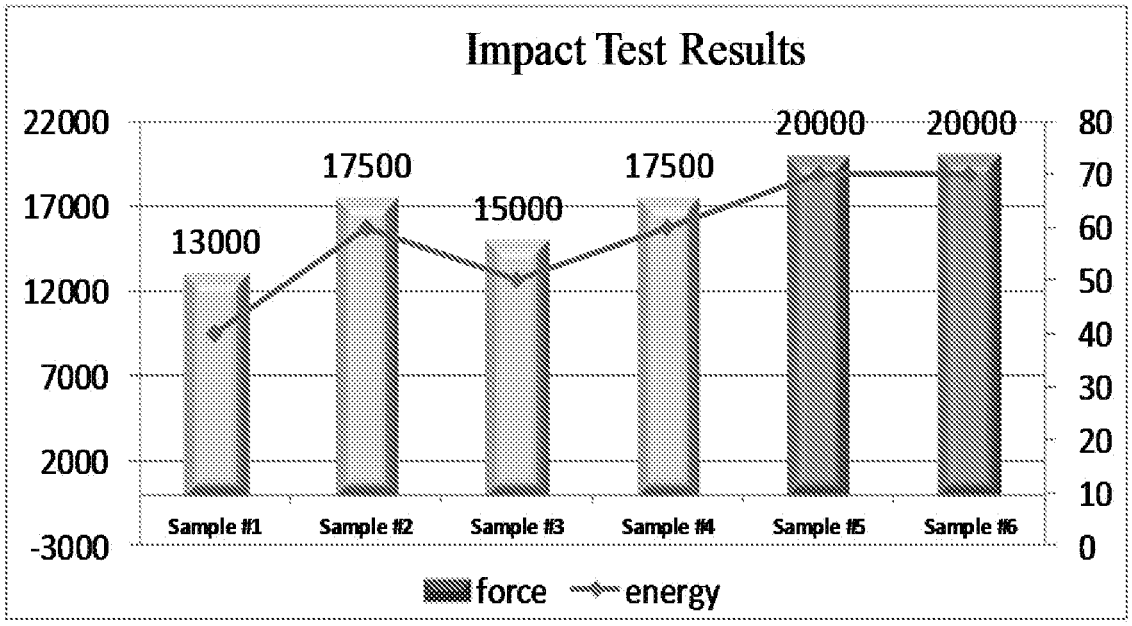
FIG. 36 is a graph of impact testing results for cutting elements having varying transition surface geometries.
Figure 37:
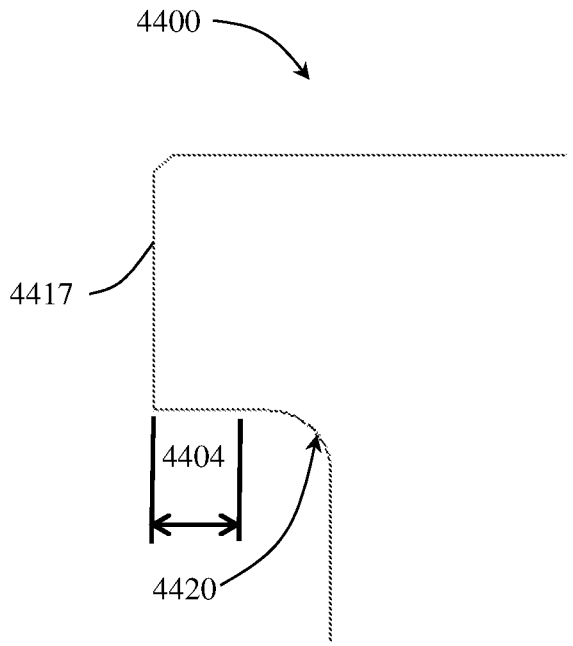
FIG. 37 is a partial cross-sectional view of a cutting element having a radiused transition surface.
Figure 38:
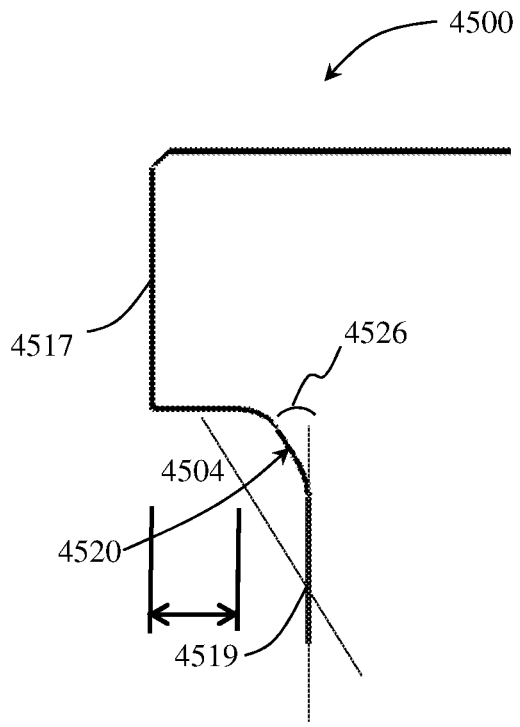
FIG. 38 is a partial cross-sectional view of a cutting element having a transition surface with at least one planar surface.

Referring now to FIG. 36, cutting elements having various transition surface geometries were tested. Cutting elements 1 through 4 included radiused transition surfaces, i.e., transition surfaces having non-planar or curved surfaces, and cutting elements 5 and 6 included a planar surface closest to the spindle that formed an angle of 30° with a line tangent to the spindle side surface. FIGS. 37 and 38 show examples of the tested cutting elements having a radiused transition surface and a transition surface with a planar surface extending at a 30° angle from a line tangent to the spindle side surface. FIG. 37 shows a partial cross-sectional view of a cutting element 4400 having a radiused transition surface 4420, wherein the radius of curvature of the transition surface 4420 is about 0.04 in. (1 mm). FIG. 38 shows a partial cross-sectional view of a cutting element 4500 with a transition surface 4520 having a planar surface closest to the spindle side surface 4519, wherein the planar surface extends at a 30° angle from a line tangent to the spindle side surface 4519. Both cutting element 4400 and cutting element 4500 have an interface surface 4404, 4504 extending an equal radial distance from a cutting end side surface 4417, 4517 to the transition surface 4420, 4520.

As shown in FIG. 36, cutting elements (samples 5 and 6) having a planar surface closest to the spindle forming an angle of 30° with a line tangent to the spindle side surface outperformed cutting elements (samples 1-4) having a radiused transition surface in impact testing. The impact tests used for testing cutting elements 1-6 included holding the cutting elements 1-6 in a testing machine at a 20° back rake angle, while a steel bar anvil (having a hardness of 62 Rockwell Hardness C (HRC)) impacted the cutting end of the cutting element. Each cutting element was impacted five times with the steel bar anvil at a force interval. Results of the impact testing are shown in FIG. 36, where the cutting elements (samples 1-4) having a radiused transition surface failed during impact testing at 13,000 lbf (5,897 kgf), 17,500 lbf (7,938 kgf), 15,000 lbf (6,804 kgf) and 17,500 lbf (7,938 kgf) and energy of 40 J, 60 J, 50 J, and 60 J, respectively. The cutting elements (samples 5 and 6) having a planar surface closest to the spindle forming an angle of 30° with a line tangent to the spindle side surface did not fail before the impact machine reached its limit, at 20,000 lbf (9,072 kgf) and 70 J.

Figure 39:
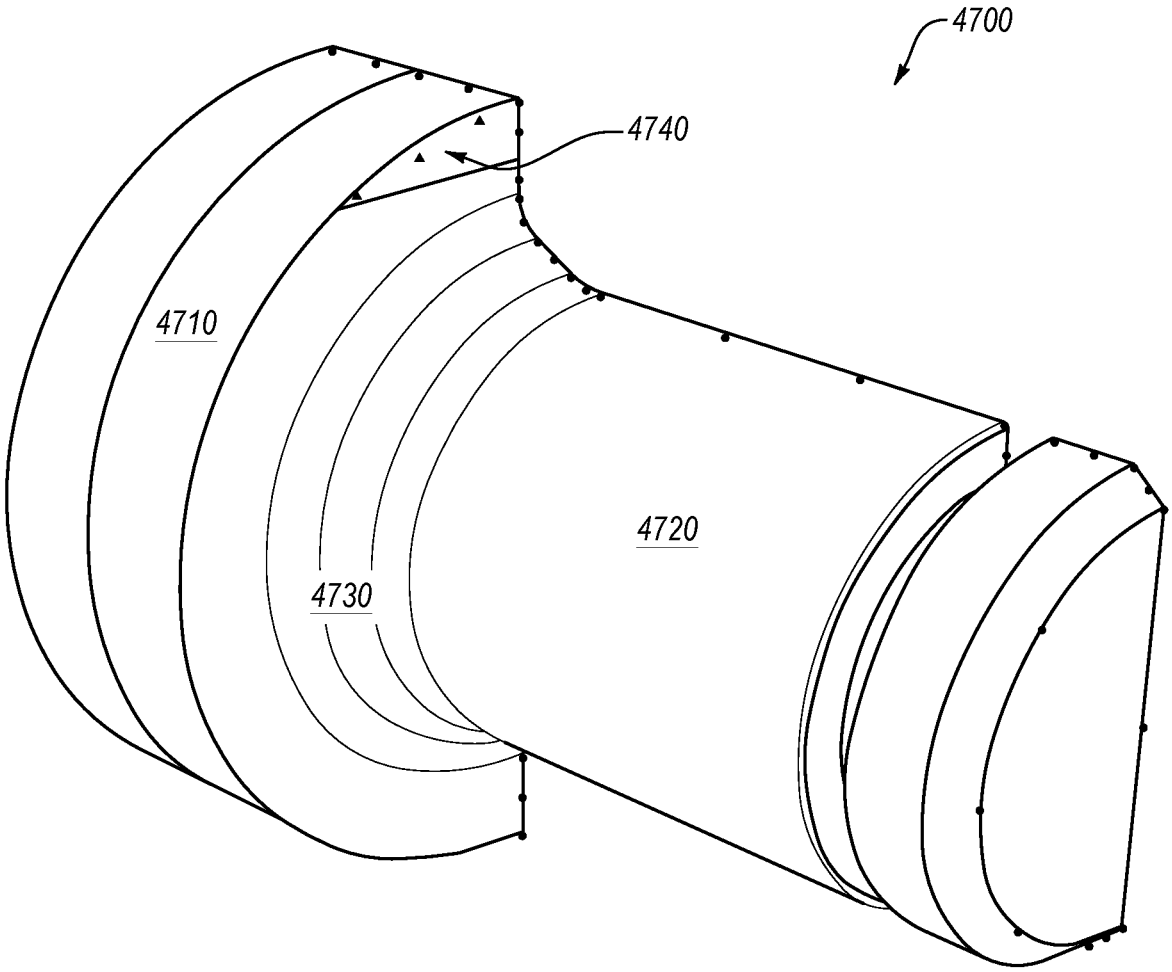
FIG. 39 shows a finite element analysis (FEA) simulation of a cutting element.

Referring now to FIGS. 39 to 43, FEA simulations were performed to test the bending strength of cutting elements having various transition surface geometries. Particularly, FIG. 39 shows a simulated cutting element 4700 for FEA, where the cutting element 4700 includes a cutting end 4710, a spindle 4720, and a transition surface 4730 connecting the cutting end 4710 to the spindle 4720. A vertical load 4740 of 10,000 psi (69,000 kPa) was applied to the interface surface, or back, of the cutting end 4710 to predict the bending strength of the transition area.

Figure 1:
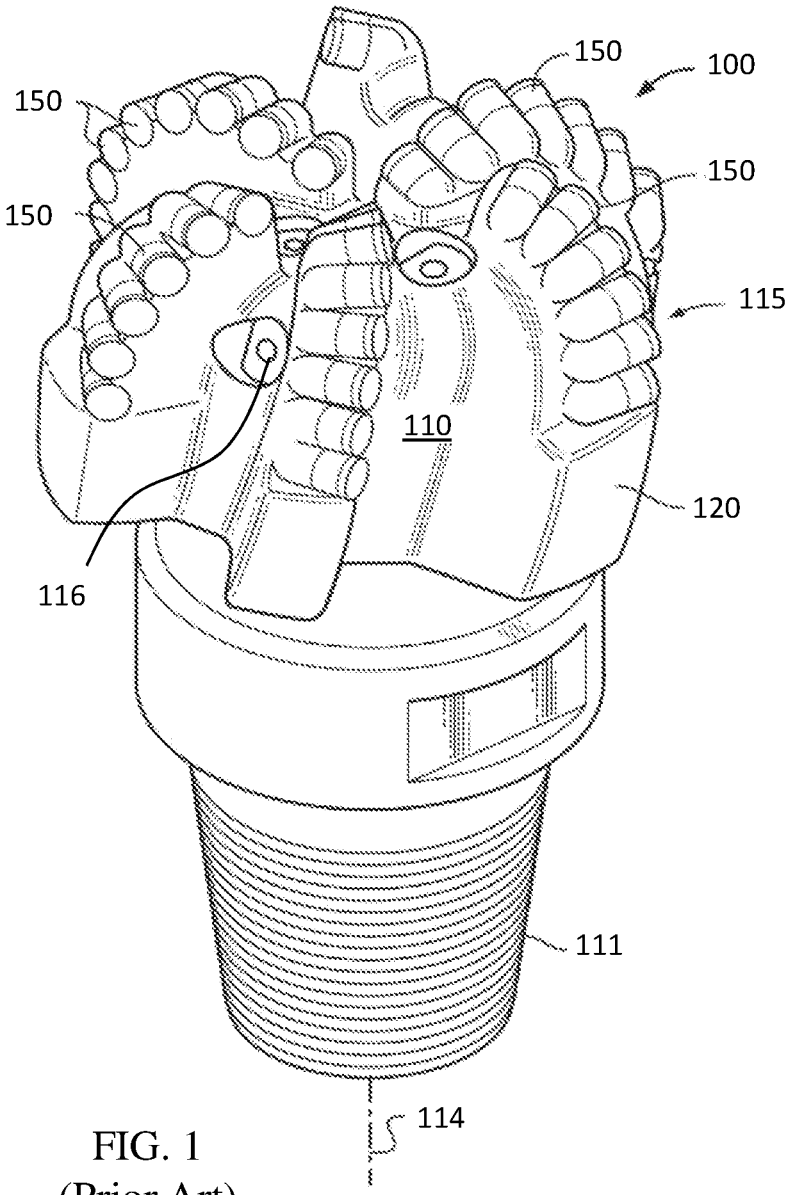
FIG. 1 (Prior Art)
FIG. 1 is a side view of a drag bit.
Figure 2:
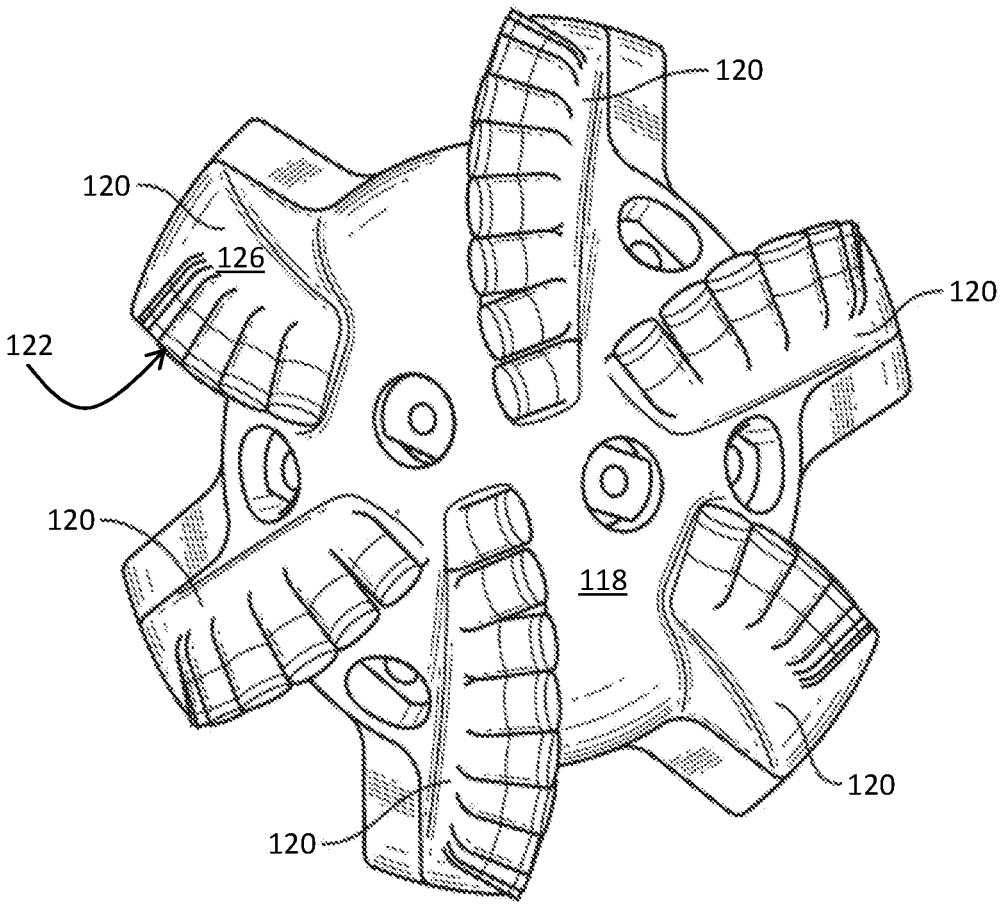
FIG. 2 (Prior Art)
FIG. 2 is a top view of the drag bit of FIG. 1.
Figures 1, 40:
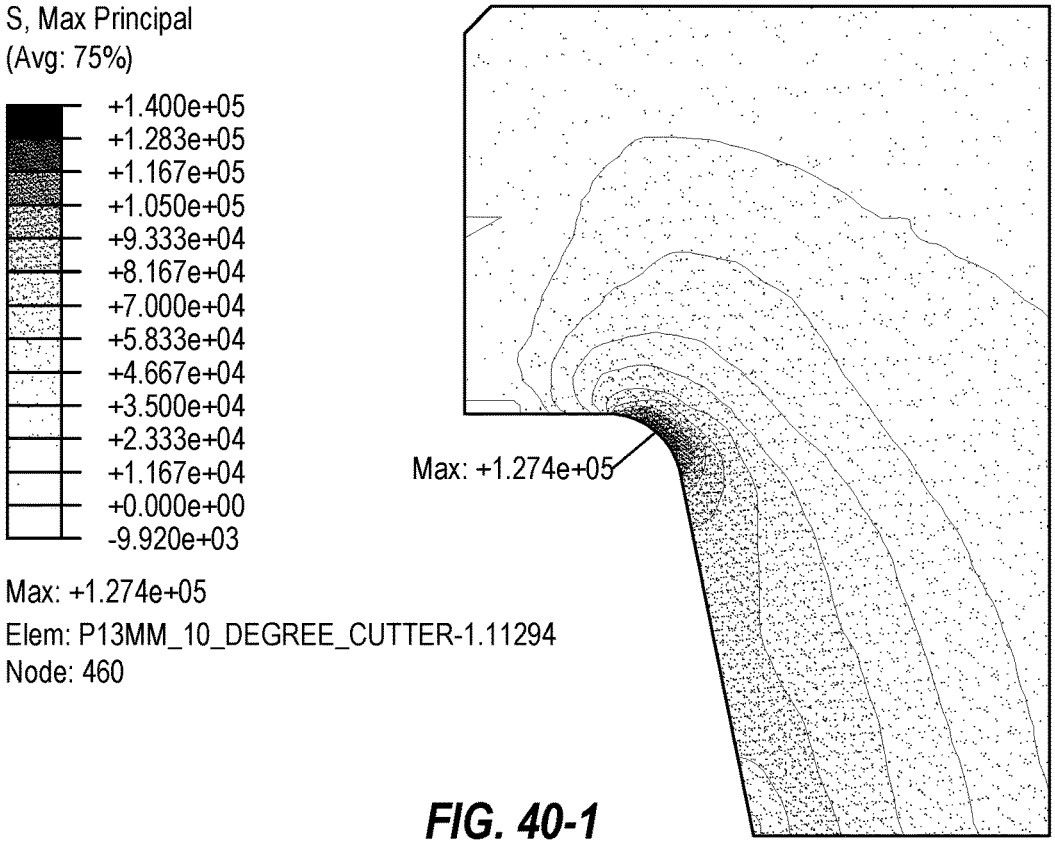
Figures 2, 40:
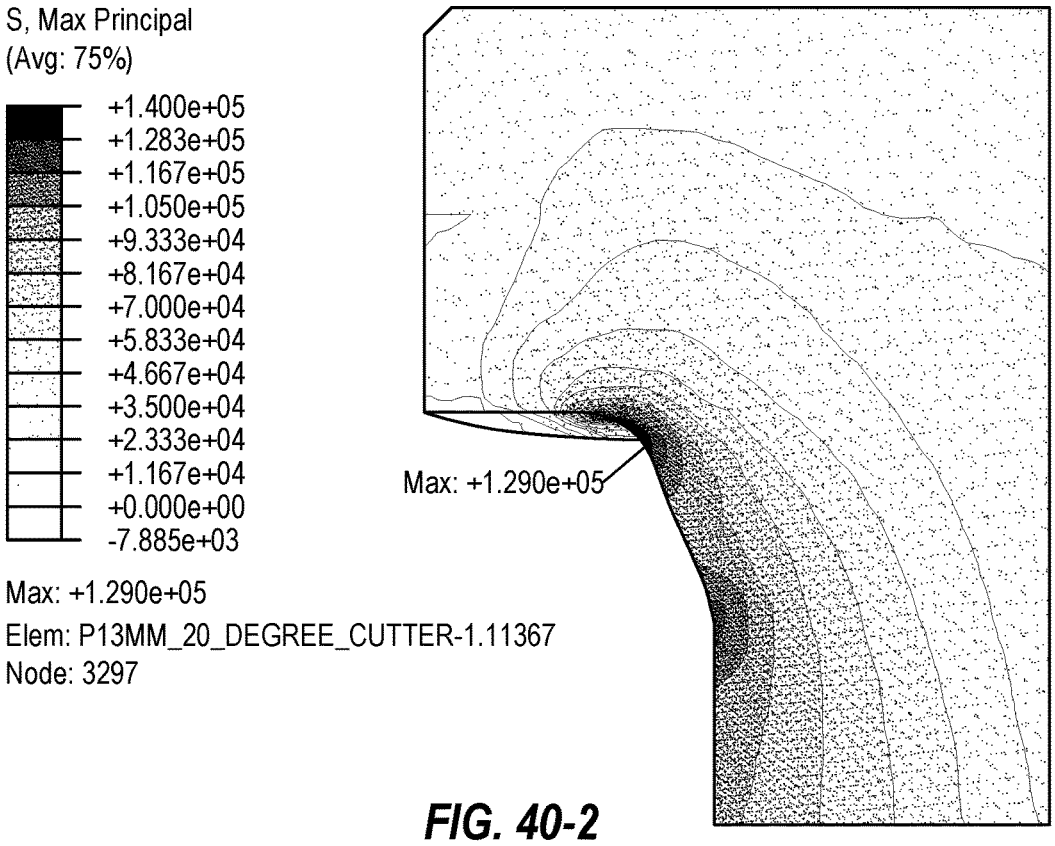
Figures 3, 40:
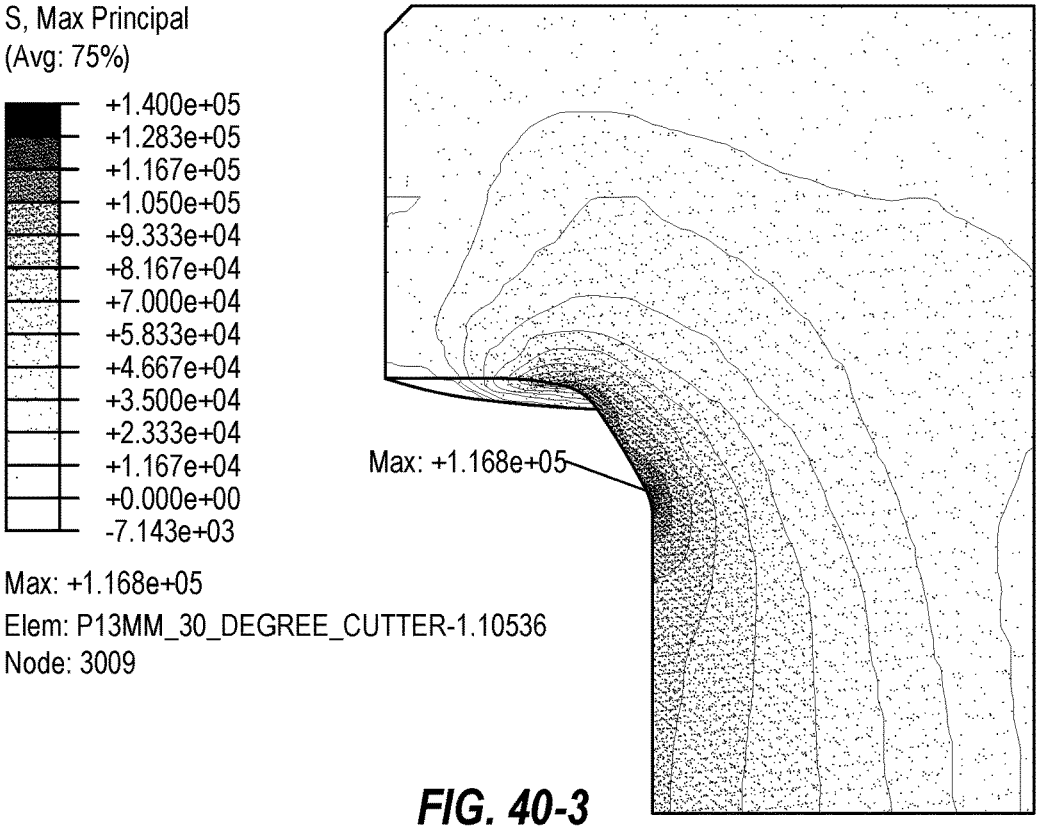
Figures 4, 40:
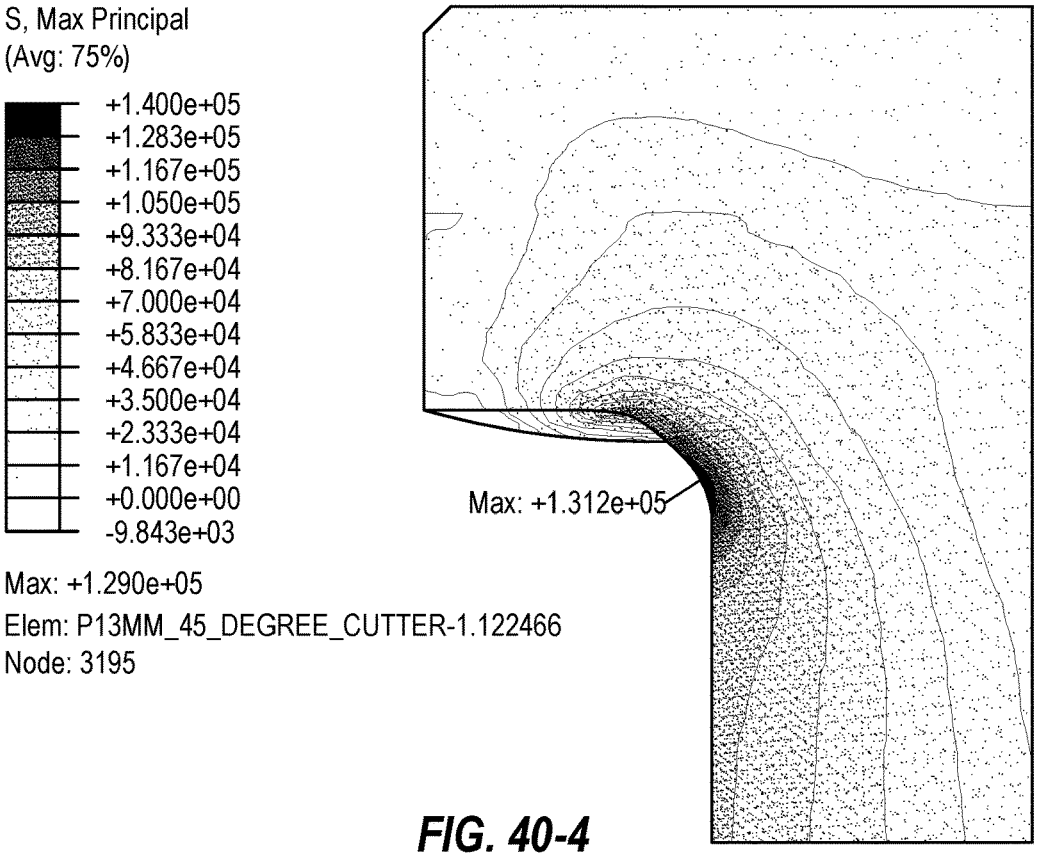
Figures 5, 40:
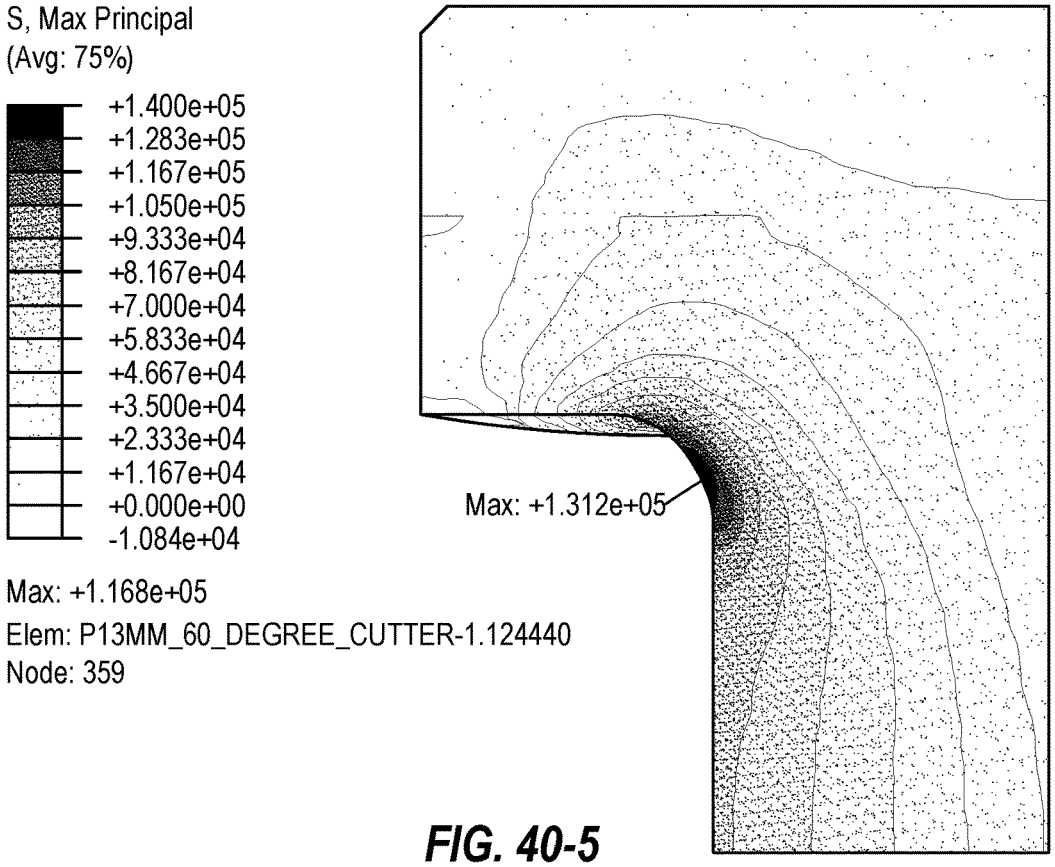
Figures 6, 40:
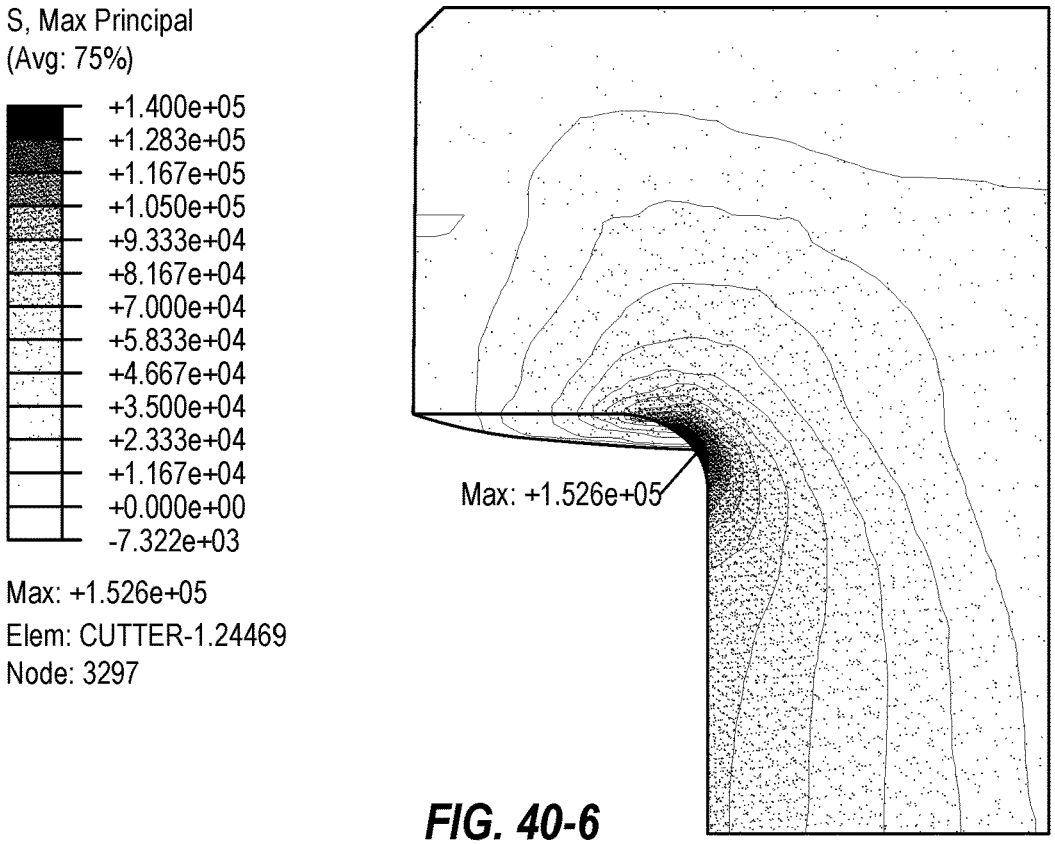

FIGS. 40-1 to 40-6 show the results of the FEA simulations performed for cutting elements having a 13 mm cutting end diameter, wherein the darker regions indicate higher stress concentrations. FIG. 40-1 shows the simulation results for a cutting element having a transition surface with a planar surface closest to the spindle extending at a 10° angle from a line tangent to the spindle side surface. FIG. 40-2 shows the simulation results for a cutting element having a transition surface with a planar surface closest to the spindle extending at a 20° angle from a line tangent to the spindle side surface. FIG. 40-3 shows the simulation results for a cutting element having a transition surface with a planar surface closest to the spindle extending at a 30° angle from a line tangent to the spindle side surface. FIG. 40-4 shows the simulation results for a cutting element having a transition surface with a planar surface closest to the spindle extending at a 45° angle from a line tangent to the spindle side surface. FIG. 40-5 shows the simulation results for a cutting element having a transition surface with a planar surface closest to the spindle extending at a 60° angle from a line tangent to the spindle side surface. FIG. 40-6 shows the simulation results for a cutting element having a radiused transition surface, i.e., a transition surface without a planar surface.

Figure 41:
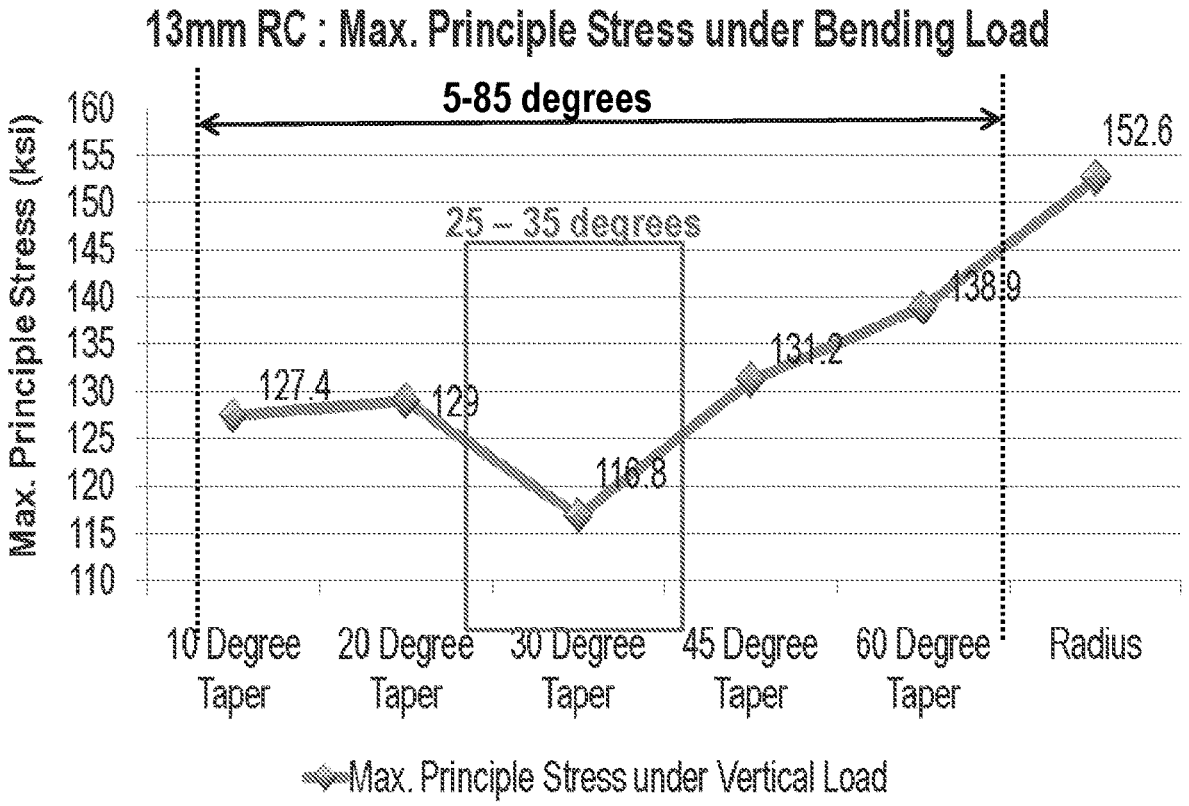
FIG. 41 is a graph of the maximum principle stresses of the FEA simulation results of FIGS. 40-1 to 40-6.

FIG. 41 shows a graph of the simulation results shown in FIGS. 40-1 to 40-6, wherein the maximum principle stress experienced by each cutting element is plotted. As shown, the cutting element tested in FIG. 40-3 (having a transition surface with a planar surface closest to the spindle extending at a 30° angle from a line tangent to the spindle side surface) experienced the lowest maximum principle stress under the applied vertical load.

Figures 1, 42:
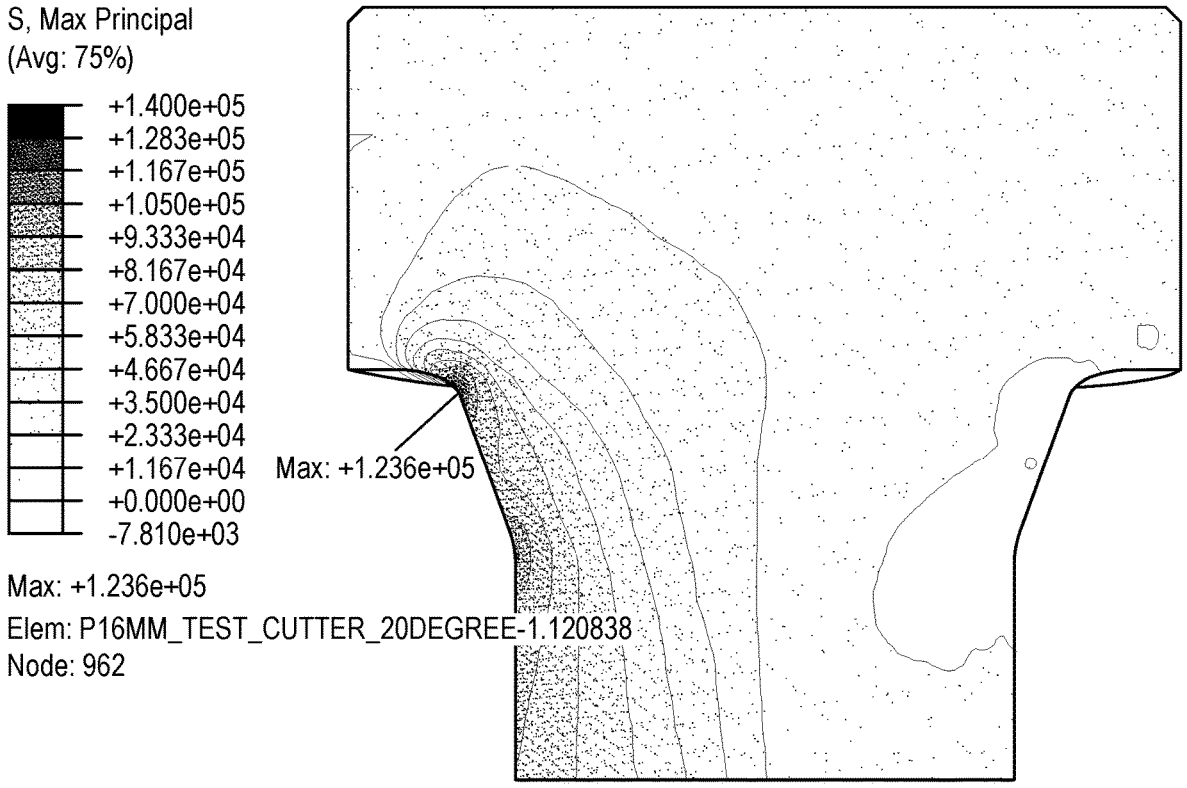
Figures 2, 42:
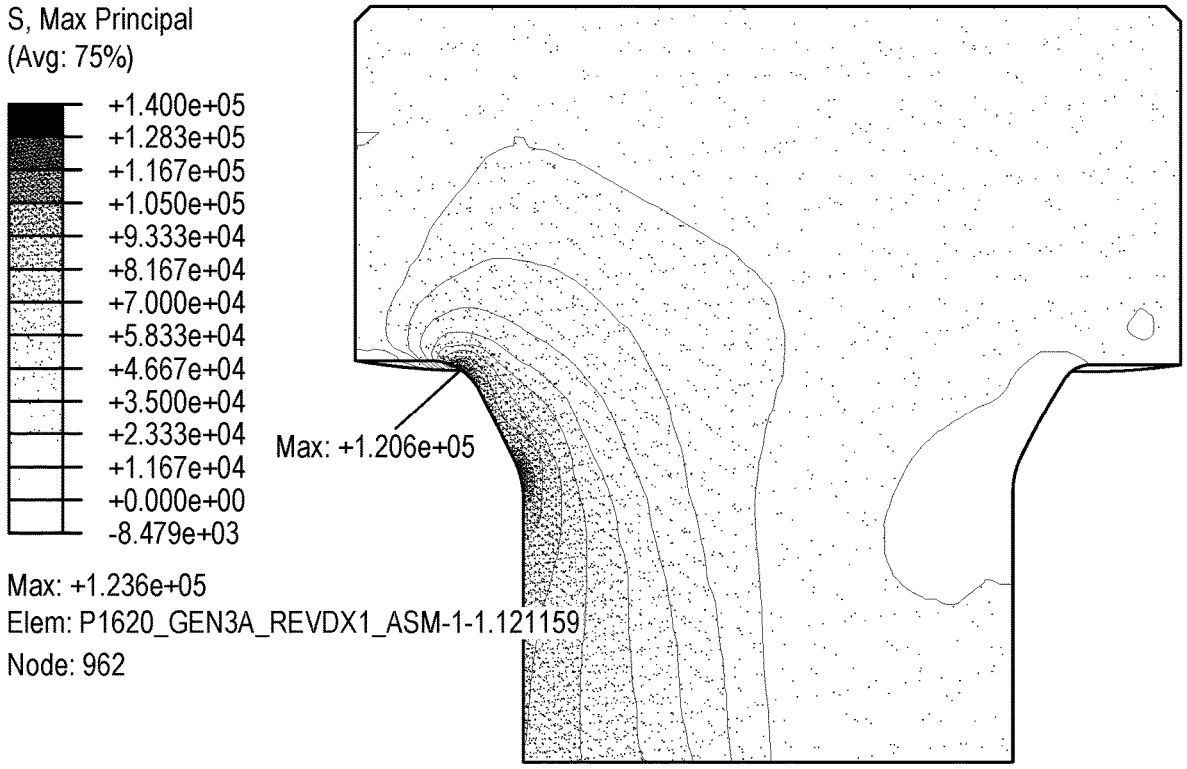
Figures 3, 42:
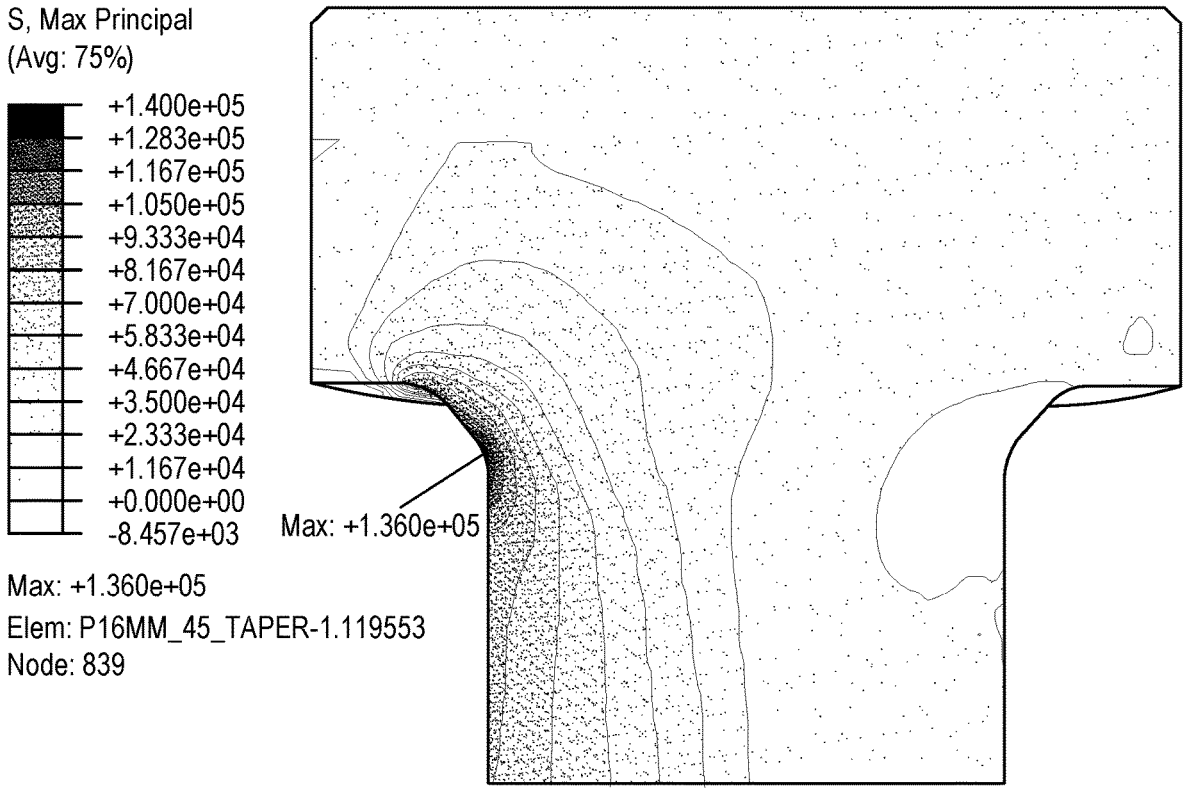
Figures 4, 42:
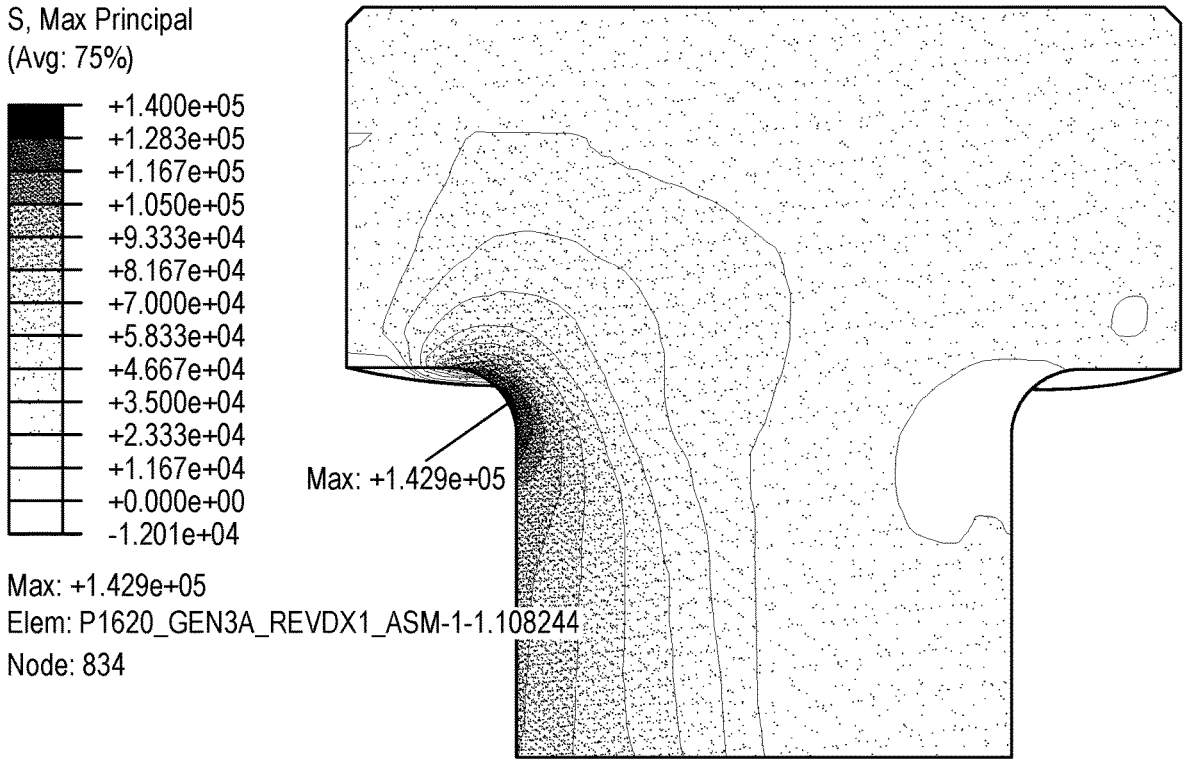

FIGS. 42-1 to 42-4 show results for FEA simulations performed for cutting elements having a 16 mm cutting end diameter, wherein the darker regions indicate higher stress concentrations. FIG. 42-1 shows the simulation results for a cutting element having a transition surface with a planar surface closest to the spindle extending at a 20° angle from a line tangent to the spindle side surface. FIG. 42-2 shows the simulation results for a cutting element having a transition surface with a planar surface closest to the spindle extending at a 30° angle from a line tangent to the spindle side surface. FIG. 42-3 shows the simulation results for a cutting element having a transition surface with a planar surface closest to the spindle extending at a 45° angle from a line tangent to the spindle side surface. FIG. 42-4 shows the simulation results for a cutting element having a radiused transition surface, i.e., a transition surface without a planar surface.

Figure 43:
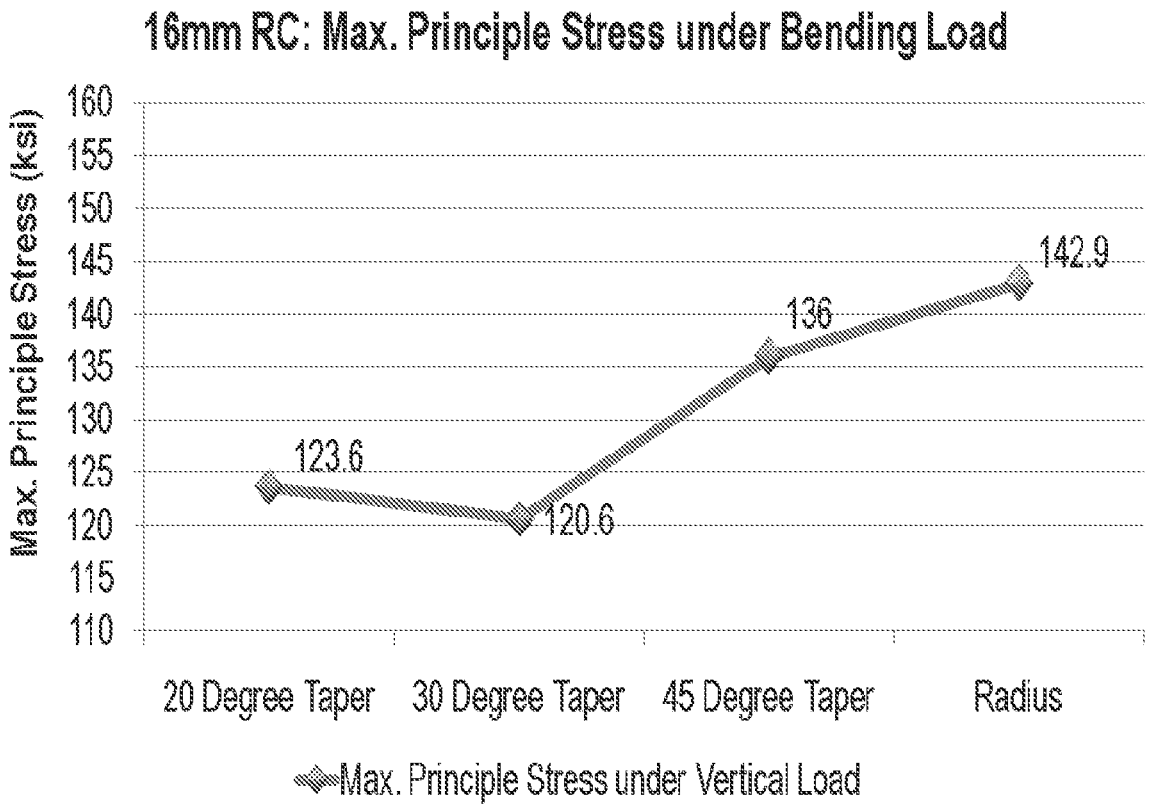
FIG. 43 is a graph of the maximum principal stresses of the FEA simulation results of FIGS. 42-1 to 42-4.

FIG. 43 shows a graph of the simulation results shown in FIGS. 42-1 to 42-4, wherein the maximum principle stress experienced by each cutting element is plotted. As shown, the cutting element tested in FIG. 50.2 (having a transition surface with a planar surface closest to the spindle extending at a 30° angle from a line tangent to the spindle side surface) experienced the lowest maximum principle stress under the applied vertical load.

One or more embodiments described herein may have an ultrahard material on a substrate. Such ultrahard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by substantially removing metal from the interstitial spaces between interconnected diamond particles or from a diamond/silicon carbide composite, or other ultrahard material such as a cubic boron nitride. Further, in particular embodiments, the rolling cutter may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

Thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are generally found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344, which are incorporated herein by this reference in their entireties. Briefly, a strong acid, such as hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such as described in U.S. Pat. No. 5,127,923, which is herein incorporated by reference in its entirety.

In one or more other embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume %, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, thermally stable diamond layer may be formed by other methods, including, for example, by altering processing conditions in the formation of the diamond layer. The substrate on which the cutting face is optionally located or formed may be formed of a variety of hard or ultrahard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. Various metal carbide compositions and binders may be used, in addition to tungsten carbide and cobalt. Thus, references to the use of tungsten carbide and cobalt are for illustrative purposes, and no limitation on the type of substrate or binder used is intended. In another embodiment, the substrate may also be formed from a diamond ultrahard material such as polycrystalline diamond or thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be desirable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

A sleeve may be formed from a variety of materials. In one embodiment, the sleeve may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13%. It is also within the scope of the present disclosure that the sleeve and/or substrate may also include one more lubricious materials, such as diamond to reduce the coefficient of friction therebetween. The components may be formed of such materials in their entirely or have portions of the components including such lubricious materials deposited on the component, such as by chemical plating, chemical vapor deposition ("CVD") including hollow cathode plasma enhanced CVD, physical vapor deposition, vacuum deposition, arc processes, or high velocity sprays). In a particular embodiment, a diamond-like coating may be deposited through CVD or hallow cathode plasma enhanced CVD, such as the type of coatings disclosed in U.S. Publication No. 2010/0108403.

In embodiments using a sleeve, such sleeve may be fixed to the bit body (or other cutting tool) by any means known in the art, including by casting in place during sintering the tool, or by brazing the element in place in the cutter pocket. Brazing may occur before or after the inner cutting element is retained within the sleeve; however, in some embodiments, the inner rotatable cutting element is retained in the sleeve before the sleeve is brazed into place. Other embodiments of a cutting element assembly may include a cutting element axially retained within an outer support, which may include, for example, a portion of the cutting tool on which the cutting element assembly is formed.

Figure 22:
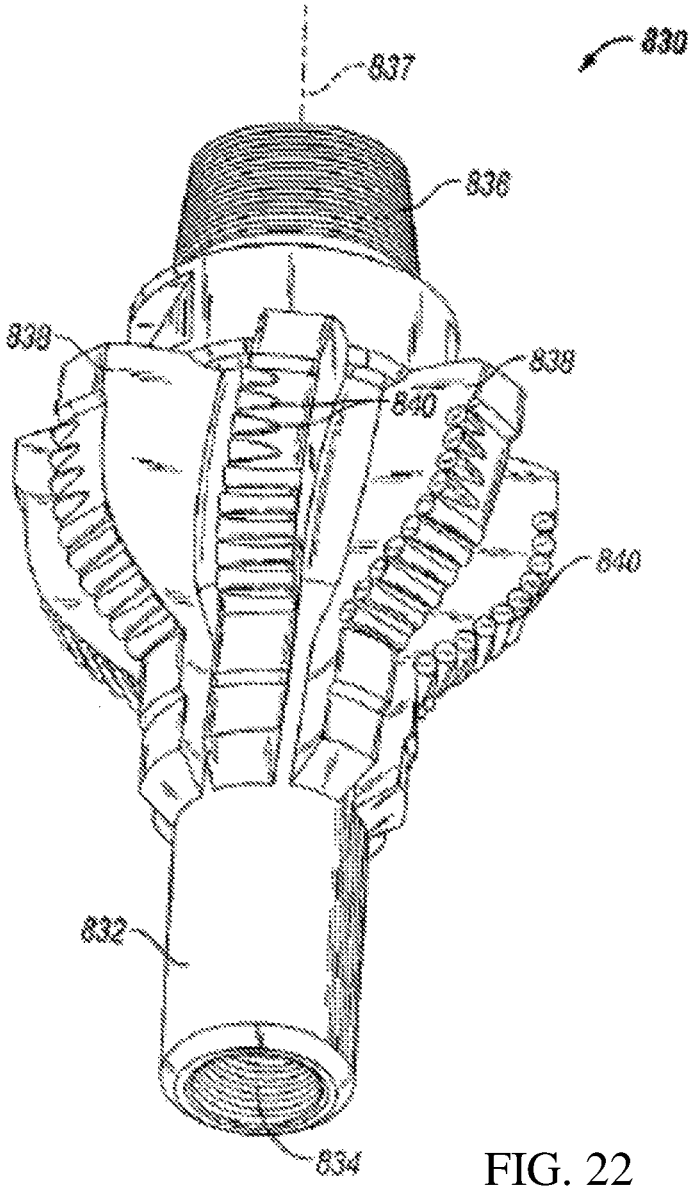
FIG. 22 is a perspective view of a tool using cutting element assemblies of the present disclosure.

Cutting element assemblies of the present disclosure may be used on any downhole cutting tool, including, for example, a fixed cutter drill bit or hole opener. FIG. 22 shows a general configuration of a hole opener 830 that includes one or more cutting element assemblies 840 of the present disclosure. The hole opener 830 includes a tool body 832 and a plurality of blades 838 at selected azimuthal locations about a circumference thereof. The hole opener 830 generally includes connections 834, 836 (e.g., threaded connections) so that the hole opener 830 may be coupled to adjacent drilling tools that comprise, for example, a drill-string and/or bottom hole assembly ("BHA"). The tool body 832 generally includes a bore therethrough so that drilling fluid may flow through the hole opener 830 as it is pumped from the surface (e.g., from surface mud pumps) to a bottom of the wellbore. The tool body 832 may be formed from steel or from other materials known in the art. For example, the tool body 832 may also be formed from a matrix material infiltrated with a binder alloy. The blades 838 shown in FIG. 22 are spiral blades and are generally positioned at substantially equal angular intervals about the perimeter of the tool body. This arrangement is not a limitation on the scope of the disclosure, but rather is used merely to illustrative purposes. Those having ordinary skill in the art will recognize that any downhole cutting tool may be used. While FIG. 22 does not detail the location of the cutting element assemblies, their placement on the tool may be according to the variations described above.

Although just a few embodiments have been described in detail above, those skilled in the art will appreciate that many modifications are possible in the example embodiments without materially departing from the apparatus, systems, and methods disclosed herein. Accordingly, such modifications are intended to be included within the scope of this disclosure. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function or functional claiming for any limitations of any of the claims herein, except for those in which the claim expressly uses the words 'means for' together with an associated function. Each addition, deletion, and modification to the embodiments that fall within the meaning and scope of the claims is to be embraced by the claims. Features and components of the various embodiments may be combined together in any combination, except where such features/components are mutually exclusive.

What is claimed is:

1. A cutting element, comprising:

a cutting end extending a depth from a cutting face to an interface surface opposite from the cutting face, the cutting end having a cutting end diameter; and a spindle, the spindle axially separated from the cutting end by a transition region, the spindle having:

a spindle diameter at a spindle side surface, the spindle diameter being less than the cutting end diameter;

a point of transition to the transition region that is disposed on the spindle and is axially separated from the interface surface of the cutting end by the transition region; and a guide length measured from the point of transition to the transition region to a retention feature, the guide length being greater than 75% of a total length of the spindle, and a fatigue life of the cutting element is based at least in part on the guide length.

2. The cutting element of claim 1, the transition region including:

a transition surface extending from a point of transition from the interface surface to a point of transition from the spindle side surface, a cross-sectional profile of the transition surface having at least one planar surface; and a taper line measured from the point of transition from the interface surface to the point of transition from the spindle side surface and forming a taper angle with a line tangent to the spindle side surface, the taper angle being between 5° and 85°.

3. The cutting element of claim 1, the guide length being greater than 60% of a total length of the cutting element.

4. The cutting element of claim 1, the guide length being greater than 60% of the cutting end diameter.

5. A cutting element assembly, comprising:

a sleeve having a base, an inner diameter at an inner surface of the sleeve, and an outer diameter at an outer surface of the sleeve;

a taper extending axially a length from the base along the sleeve, the taper being formed by a decreasing outer diameter; and a cutting element having a cutting end, a spindle having a spindle side surface, and a retention feature disposed along the spindle side surface, the spindle being within the sleeve such that the taper axially overlaps the retention feature.

6. The cutting element assembly of claim 5, the cutting element having a transition region between the cutting end and the spindle, the transition region including:

a transition surface extending from a point of transition from a cutting end surface to a point of transition from the spindle side surface, a cross-sectional profile of the transition surface having at least one planar surface; and a taper line measured from the point of transition from the cutting end surface to the point of transition from the spindle side surface and forming a taper angle with a line tangent to the spindle side surface, the taper angle being between 5° and 85°.

7. The cutting element assembly of claim 5, the spindle being axially separated from the cutting end by a transition region, and the spindle including:

a guide length measured from the retention feature to a point of transition to the transition region, the guide length being longer than 75% of a total length of the spindle.

8. The cutting element assembly of claim 5, the spindle being axially separated from the cutting end by a transition region, and the spindle including:

a guide length measured from a point of transition to the transition region to the retention feature, the guide length being longer than 0.3 in. (7.6 mm).

9. The cutting element assembly of claim 5, the retention feature including:

a circumferential groove formed around the spindle side surface and a corresponding circumferential groove formed around the inner surface of the sleeve; and a retention mechanism between the corresponding circumferential grooves.

10. The cutting element assembly of claim 5, a ratio of a total length of the cutting element assembly to a diameter of the cutting element assembly being greater than 1:1.

11. The cutting element assembly of claim 5, the taper extending at least 25% of a total length of the sleeve.

12. The cutting element assembly of claim 5, a ratio of a gap formed between the inner surface of the sleeve and the spindle side surface along a shared axial position and the diameter of the cutting element assembly being between 0.0005 and 0.02.

13. The cutting element assembly of claim 5, further comprising at least one seal between the cutting element and the sleeve.

14. A cutting element assembly, comprising:

a cutting element, the cutting element including:

a cutting end extending a depth from a cutting face to an interface surface opposite the cutting face;

a spindle, a spindle diameter measured at a spindle side surface being less than a cutting end diameter measured at a cutting end side surface;

a transition region having a transition surface extending from a point of transition from the interface surface to a point of transition from the spindle side surface, a cross-sectional profile of the transition surface having at least one planar surface adjacent the spindle side surface, wherein the at least one planar surface forms an angle with a line tangent to the spindle side surface between 25° to 35°; and a taper line measured from the point of transition from the interface surface to the point of transition from the spindle side surface, the taper line forming a taper angle with the line tangent to the spindle side surface, the taper angle ranging from 25° to 85°;

an outer support, the spindle being within the outer support; and a retention feature between the spindle and the outer support.

15. The cutting element assembly of claim 14, the outer support being a sleeve, the sleeve including:

an inner diameter measured at an inner surface of the sleeve;

an outer diameter measured at an outer surface of the sleeve; and a taper formed by a decreasing outer diameter and extending axially from a base of the sleeve a length along the sleeve, the taper axially overlapping the retention feature.

16. The cutting element assembly of claim 14, the spindle including a guide length measured from the point of transition from the spindle side surface to the retention feature, the guide length being greater than 75% of a total length of the spindle.

17. A downhole cutting tool comprising a tool body, a plurality of blades extending therefrom, and at least one cutting element assembly of claim 14 on at least one of the plurality of blades, the at least one of the plurality of blades forming the outer support.

18. The cutting element assembly of claim 14, the outer support being a sleeve and the cutting element assembly further comprising:

at least one seal between the sleeve and the cutting element, the at least one seal having a quadrilateral cross-sectional shape.

19. The cutting element assembly of claim 18, a cross-sectional profile of the transition region including a planar surface, the at least one seal being disposed along the planar surface of the transition region.

20. The cutting element assembly of claim 18, the at least one seal having a metal core.

* * * * *